US007679476B2

(12) United States Patent
Kubono et al.

(10) Patent No.: US 7,679,476 B2
(45) Date of Patent: Mar. 16, 2010

(54) POLARIZED ELECTROMAGNETIC RELAY AND COIL ASSEMBLY

(75) Inventors: Kazuo Kubono, Shinagawa (JP); Shinichi Sato, Shinagawa (JP)

(73) Assignee: Fujitsu Componenet Limited, Tokyo (JP)

( * ) Notice: Subject to any disclaimer, the term of this patent is extended or adjusted under 35 U.S.C. 154(b) by 213 days.

(21) Appl. No.: 12/068,037

(22) Filed: Jan. 31, 2008

(65) Prior Publication Data

US 2008/0180197 A1 Jul. 31, 2008

(30) Foreign Application Priority Data

Jan. 31, 2007 (JP) ..... 2007-021535
Sep. 28, 2007 (JP) ..... 2007-255377

(51) Int. Cl.
*H01H 51/22* (2006.01)
*H01H 67/02* (2006.01)

(52) U.S. Cl. ..... 335/78; 335/80; 335/81; 335/82; 335/83; 335/84; 335/85; 335/86; 335/126

(58) Field of Classification Search ..... 335/78–86, 335/126, 129, 131, 153, 179, 180, 203–205, 335/220, 222, 229
See application file for complete search history.

(56) References Cited

U.S. PATENT DOCUMENTS 3,271,707 A * 9/1966 Koehler ..... 335/78
4,122,420 A * 10/1978 Brown ..... 335/80
4,621,246 A * 11/1986 Nagamoto et al. ..... 335/78
4,740,771 A * 4/1988 Motoyama et al. ..... 335/274
5,291,166 A * 3/1994 Chikira ..... 335/78
5,389,905 A * 2/1995 Shibata et al. ..... 335/78
6,046,660 A 4/2000 Gruner
6,046,661 A * 4/2000 Reger et al. ..... 335/185
6,320,485 B1 * 11/2001 Gruner ..... 335/78
6,359,537 B1 * 3/2002 Ichikawa et al. ..... 335/85

(Continued)

FOREIGN PATENT DOCUMENTS

EP 0 257 607 3/1988

(Continued)

OTHER PUBLICATIONS

Partial European Search Report issued Jun. 16, 2008 in corresponding European Patent Application No. 08150892.1.

*Primary Examiner*—Anh T Mai
*Assistant Examiner*—Mohamad A Musleh
(74) *Attorney, Agent, or Firm*—Staas & Halsey LLP

(57) ABSTRACT

A polarized electromagnetic relay including an electromagnet assembly, a contact section insulated from the electromagnet assembly, and a force transfer member disposed between the electromagnetic assembly and the contact section. The electromagnet assembly includes an electromagnet, an armature driven by the electromagnet, and a permanent magnet carried on the armature. The armature includes first and second electrically conductive plate elements holding the permanent magnet therebetween in a direction of magnetization of the permanent magnet and disposed to orient the direction of magnetization in parallel with the center axis of the coil. The armature is arranged linearly movably in a direction parallel with the center axis in a state where a part of the first electrically conductive plate element is inserted into a space between the outer peripheral region of the iron core head portion and the distal end region of the yoke major portion.

17 Claims, 20 Drawing Sheets

U.S. PATENT DOCUMENTS 6,426,689 B1 * 7/2002 Nakagawa et al. ..... 335/78

FOREIGN PATENT DOCUMENTS

| | | |
|---|---|---|
| FR | 2 616 959 | 12/1988 |
| JP | 57-30232 | 2/1982 |
| JP | 58-181227 | 10/1983 |
| JP | 61-78106 | 4/1986 |
| JP | 1-243333 | 9/1989 |
| JP | 5-81991 | 4/1993 |
| JP | 2005-183554 | 7/2005 |
| JP | 2005-243367 | 9/2005 |
| JP | 2006-210123 | 8/2006 |

* cited by examiner

POLARIZED ELECTROMAGNETIC RELAY AND COIL ASSEMBLY

BACKGROUND OF THE INVENTION

1. Field of the Invention

The present invention relates to a polarized electromagnetic relay. The present invention also relates to a coil assembly adapted to be used in a polarized electromagnetic relay.

2. Description of the Related Art

A polar or polarized electromagnetic relay, wherein an electromagnet assembly including an electromagnet and a permanent magnet as well as a contact section including a plurality of contact members are insulated from each other and attached to a base, and wherein a force transfer member shiftable under an action of the electromagnet assembly to make the contact members of the contact section open or close is disposed between the electromagnet assembly and the contact section, has been known in the art. For example, Japanese Unexamined Patent Publication (Kokai) No. 58-181227 (JP-A-58-181227) discloses a polarized electromagnetic relay of this type, in which an electromagnet assembly is configured so that a magnetic movable element (referred to as "an armature section" in JP-A-58-181227) including a permanent magnet and a pair of yokes or iron plates, holding the permanent magnet therebetween, linearly shifts in a direction parallel with a center axis of a coil in response to the excitation of the electromagnet. Typically, the electromagnet assembly configured as described above has an advantage that outside dimensions can be effectively reduced in a redial direction of the coil of the electromagnetic relay, in comparison with a configuration in which a magnetic movable element including a permanent magnet linearly shifts in a direction orthogonal to the coil center axis in response to the excitation of an electromagnet.

In the polarized electromagnetic relay disclosed in JP-A-58-181227, two large and small U-shaped yokes are assembled together to hold, between the center areas of the yokes, a permanent magnet in a direction of magnetization of the magnet, so that at longitudinally opposite end regions of the magnetic movable element, end portions of the yokes, on which respective magnetic poles are formed by the magnet, are arranged so as to face to each other. Similarly, an iron core of the electromagnet is a U-shaped member, of which longitudinally opposite ends extend in a radial direction of the coil and protrude outward. At each longitudinal end region of the magnetic movable element, each end portion of the iron core of the electromagnet is inserted into a space between the end portions of a pair of yokes, at which mutually different magnetic poles are formed. The magnetic movable element is integrally incorporated in a force transfer member as a molded component, and when the electromagnet operates under the above described relative disposition, the force transfer member linearly shifts together with the magnetic movable elements, so as to make the contact section open or close.

Further, a polarized electromagnetic relay, wherein an electromagnet includes a bobbin, on which a conductive wire is wound to form a coil, and at least three coil terminals securely supported on the bobbin, the wire of the coil being connected to each of the coil terminals (see, e.g., Japanese Unexamined Patent Publication (Kokai) No. 2005-243367 (JP-A-2005-243367)). In this type of the polarized electromagnetic relay, the coil may constitutes two excitation circuits, each of which includes a terminal pair defined by any two coil terminals of the at least three coil terminals, and thereby an advantage is given, such that an operation mode of the relay can be quickly switched between an operating state (i.e., a make-contact closing state) and a reset state (i.e., a break-contact closing state), and in either state, the contact section can be stably kept in the contact closing state.

In the polarized electromagnetic relay disclosed in JP-A-58-181227, the pair of U-shaped yokes constituting the magnetic movable element have lengths substantially corresponding to an entire length of the U-shaped iron core of the electromagnet, so that the dimension and weight of a movable section including the force transfer member are relatively large, which may influence the response (i.e., operating time) and outside dimensions of the relay. Further, in this configuration, the U-shaped iron core of the electromagnet and the U-shaped yokes of the magnetic movable element cooperate with each other by simultaneously exerting magnetic effects at their longitudinally opposite ends, so that in order to reduce unevenness of operational characteristics, it is necessary to improve the dimensional accuracy of these components, which may increase manufacturing costs.

On the other hand, in the polarized electromagnetic relay in which the electromagnet includes at least three coil terminals as described in JP-A-2005-243367, it is required to safely and accurately perform an automatic winding process for connecting the conductive wire to each coil terminal and thereby forming the coil on the bobbin.

SUMMARY OF THE INVENTION

It is an object of the present invention to provide a polarized electromagnetic relay including an electromagnet assembly configured in such a manner that a magnetic movable element including a permanent magnet is linearly shifted due to the excitation of an electromagnet in a direction parallel with a center axis of a coil, wherein the structure and driving configuration of the magnetic movable element can be simplified, so that response (or operating time) can be improved and outside dimensions and manufacturing costs can be effectively reduced.

It is another object of the present invention to provide a polarized electromagnetic relay in which an electromagnet includes at least three coil terminals, wherein an automatic winding process for connecting a wire to each coil terminal and thereby forming a coil on a bobbin can be safely and accurately performed.

It is a further object of the present invention to provide a coil assembly adapted to be used in a polarized electromagnetic relay, wherein an automatic winding process for connecting a wire to each of at least three coil terminals and thereby forming a coil on a bobbin can be safely and accurately performed.

To accomplish the above object, the present invention provides, as one aspect thereof, a polarized electromagnetic relay comprising a base; an electromagnet assembly fitted to the base, the electromagnet assembly comprising an electromagnet, an armature driven by the electromagnets and a permanent magnet carried on the armature, a contact section fitted to the base and insulated from the electromagnet assembly; and a force transfer member disposed between the electromagnet assembly and the contact section, the force transfer member being shiftable under an action of the electromagnet assembly to make the contact section open or close; wherein the electromagnet includes a coil with a center axis, an iron core provided with a shaft portion disposed along the center axis of the coil and a head portion extending outside of the coil and radially outward from one axial end of the shaft portion, and a yoke joined to another axial end of the shaft portion of the iron core and extending outside of the coil, the yoke including a major portion extending generally parallel with the center axis, an outer peripheral region of the head portion of the iron core being opposed to and spaced from a distal end region of the major portion of the yoke; wherein the armature includes first and second electrically conductive plate elements holding the permanent magnet therebetween in a direction of magnetization of the permanent magnet and disposed to orient the direction of magnetization in parallel with the center axis of the coil, the armature being arranged linearly movably in a direction parallel with the center axis in a state where a part of the first electrically conductive plate element is inserted into a space defined between the outer peripheral region of the head portion of the iron core and the distal end region of the major portion of the yoke; and wherein the force transfer member is arranged to linearly shift in a direction parallel with the center axis to make the contact section open or close, while accompanying with a linear movement of the armature driven by the electromagnet in the direction parallel with the center axis.

The present invention also provides, as another aspect thereof, a polarized electromagnetic relay comprising a base; an electromagnet assembly fitted to the base, the electromagnet assembly comprising an electromagnet, an armature driven by the electromagnet, and a permanent magnet carried on the armature; a contact section fitted to the base and insulated from the electromagnet assembly; and a force transfer member disposed between the electromagnet assembly and the contact section, the force transfer member being shiftable under an action of the electromagnet assembly to make the contact section open or close; wherein the electromagnet includes a coil with a center axis, a bobbin on which the coil is wound, and at least three coil terminals securely supported on the bobbin, a conductive wire forming the coil being connected to each of the coil terminals; wherein the coil constitutes two excitation circuits, each excitation circuit including a terminal pair defined by any two of the at least three coil terminals; wherein each of the at least three coil terminals is provided with a tying portion to which the wire is connected and a termination portion defined away from the tying portion, the tying portion and the termination portion being disposed to protrude outside of the bobbin; wherein the bobbin is provided with a first surface defining a side from which the tying portion of one coil terminal of the terminal pair in each of the two excitation circuits protrudes, and a second surface defining another side opposite to the first surface and from which the termination portion of the one coil terminal protrudes; and wherein the conductive wire is provided with a first lead portion extending between the coil and the tying portion of the one coil terminal of the terminal pair, the first lead portion being laid along the first surface of the bobbin, and a second lead portion extending between the coil and the tying portion of another coil terminal of the terminal pair, the second lead portion being laid along the second surface of the bobbin.

The present invention also provides, as a further aspect thereof, a coil assembly used in a polarized electromagnetic relay, the coil assembly comprising a coil with a center axis; a bobbin on which the coil is wound; and at least three coil terminals securely supported on the bobbin, a conductive wire forming the coil being connected to each of the coil terminals; wherein the coil constitutes two excitation circuits, each excitation circuit including a terminal pair defined by any two of the at least three coil terminals; wherein each of the at least three coil terminals is provided with a tying portion to which the wire is connected and a termination portion defined away from the tying portion, the tying portion and the termination portion being disposed to protrude outside of the bobbin; wherein the bobbin is provided with a first surface defining a side from which the tying portion of one coil terminal of the terminal pair in each of the two excitation circuits protrudes, and a second surface defining another side opposite to the first surface and from which the termination portion of the one coil terminal protrudes; and wherein the conductive wire is provided with a first lead portion extending between the coil and the tying portion of the one coil terminal of the terminal pair, the first lead portion being laid along the first surface of the bobbin, and a second lead portion extending between the coil and the tying portion of another coil terminal of the terminal pair, the second lead portion being laid along the second surface of the bobbin.

BRIEF DESCRIPTION OF THE DRAWINGS

The above and other objects, features and advantages of the present invention will become more apparent from the following description of preferred embodiments in connection with the accompanying drawings, wherein.

DESCRIPTION OF THE PREFERRED EMBODIMENT

Figure 1:
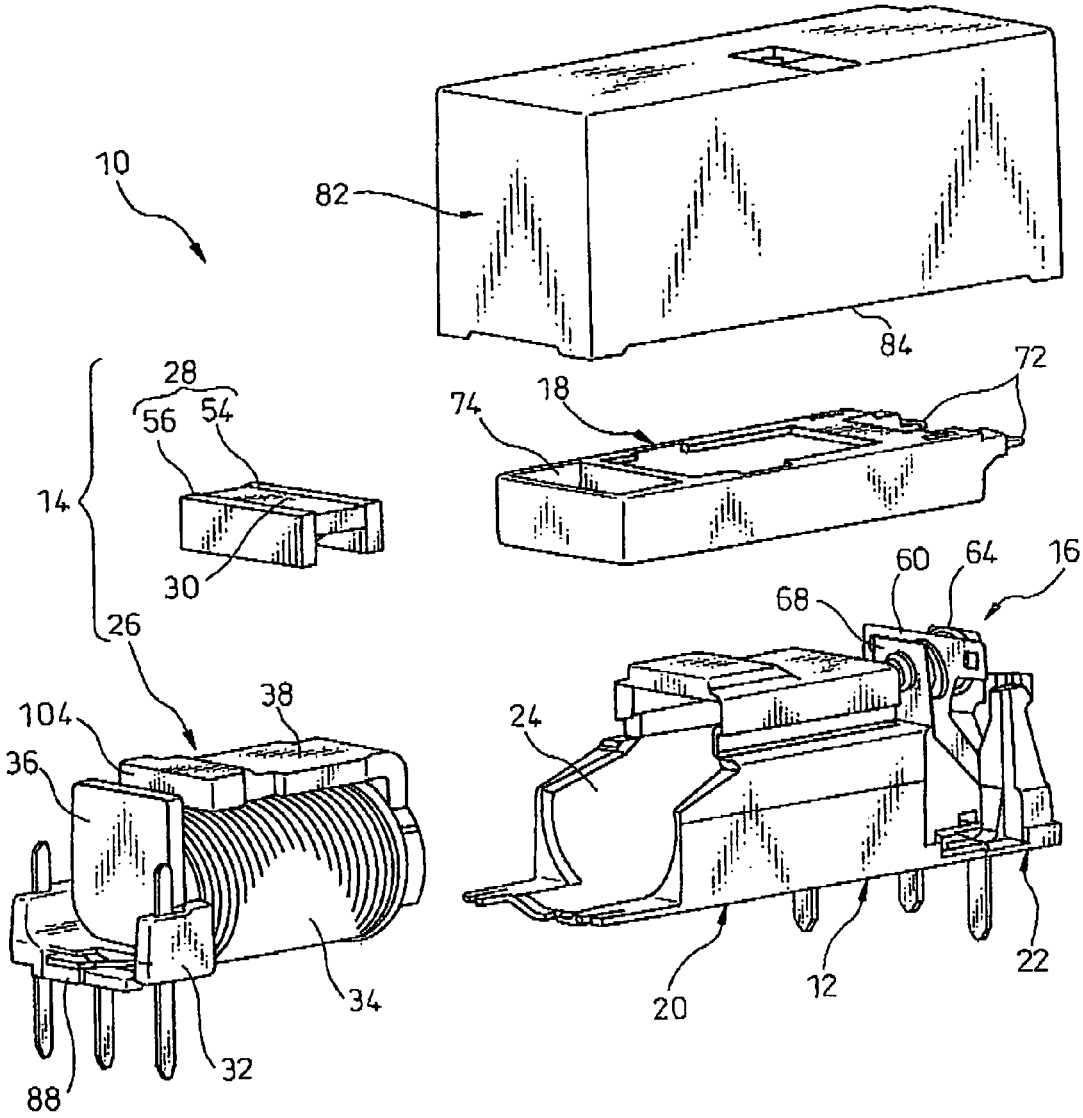
FIG. 1 is an exploded perspective view showing a polarized electromagnetic relay according to an embodiment of the present invention.

The embodiments of the present invention are described below in detail, with reference to the accompanying drawings. In the drawings, the same or similar components are denoted by common reference numerals.

Figure 2:
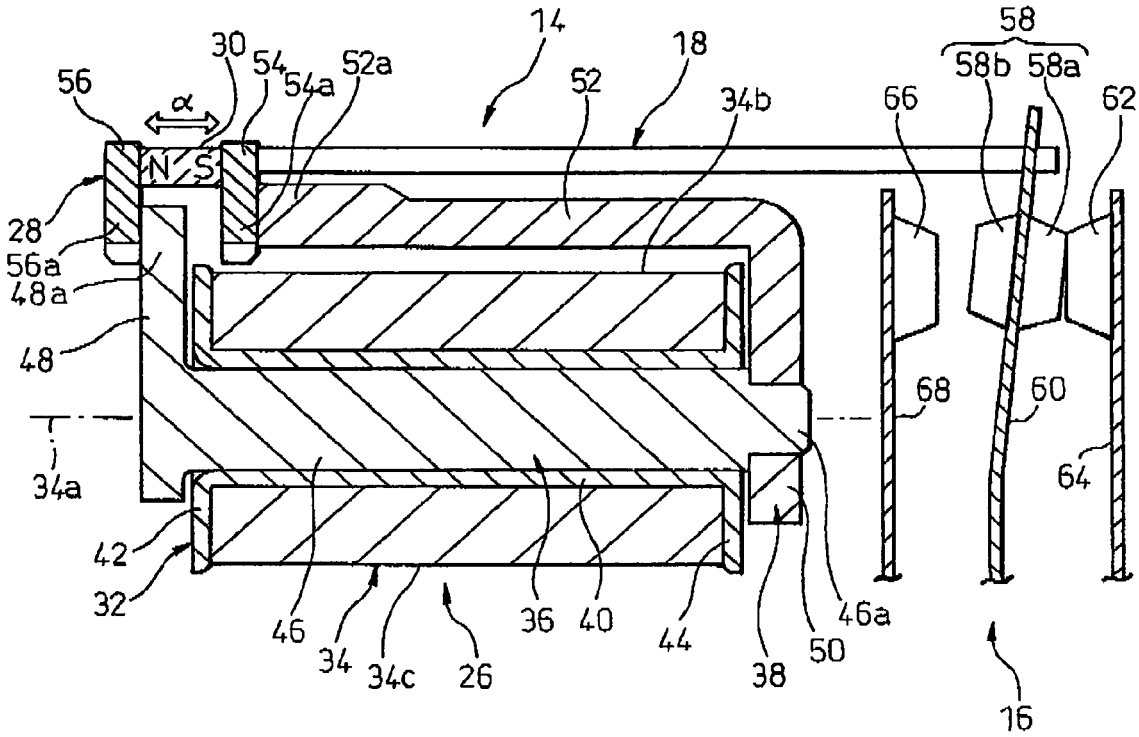
FIG. 2 is a sectional view diagrammatically showing several components of the polarized electromagnetic relay of FIG. 1 for clarifying their functions.

Referring to the drawings, FIG. 1 shows a polarized electromagnetic relay 10 according to an embodiment of the present invention in an exploded view clearly showing several components, and FIG. 2 diagrammatically shows components of the polarized electromagnetic relay 10 for clarifying their functions. Further, FIGS. 3 and 4 respectively show other components of the polarized electromagnetic relay 10.

As shown in FIGS. 1 and 2, the polarized electromagnetic relay 10 includes a base 12; an electromagnet assembly 14 fitted to the base 12; a contact section 16 fitted to the base 12 and insulated from the electromagnet assembly 14; and a force transfer member 18 disposed between the electromagnet assembly 14 and the contact section 16, the force transfer member 18 being shiftable under an action of the electromagnet assembly 14 to make the contact section 16 open or close.

Figure 3:
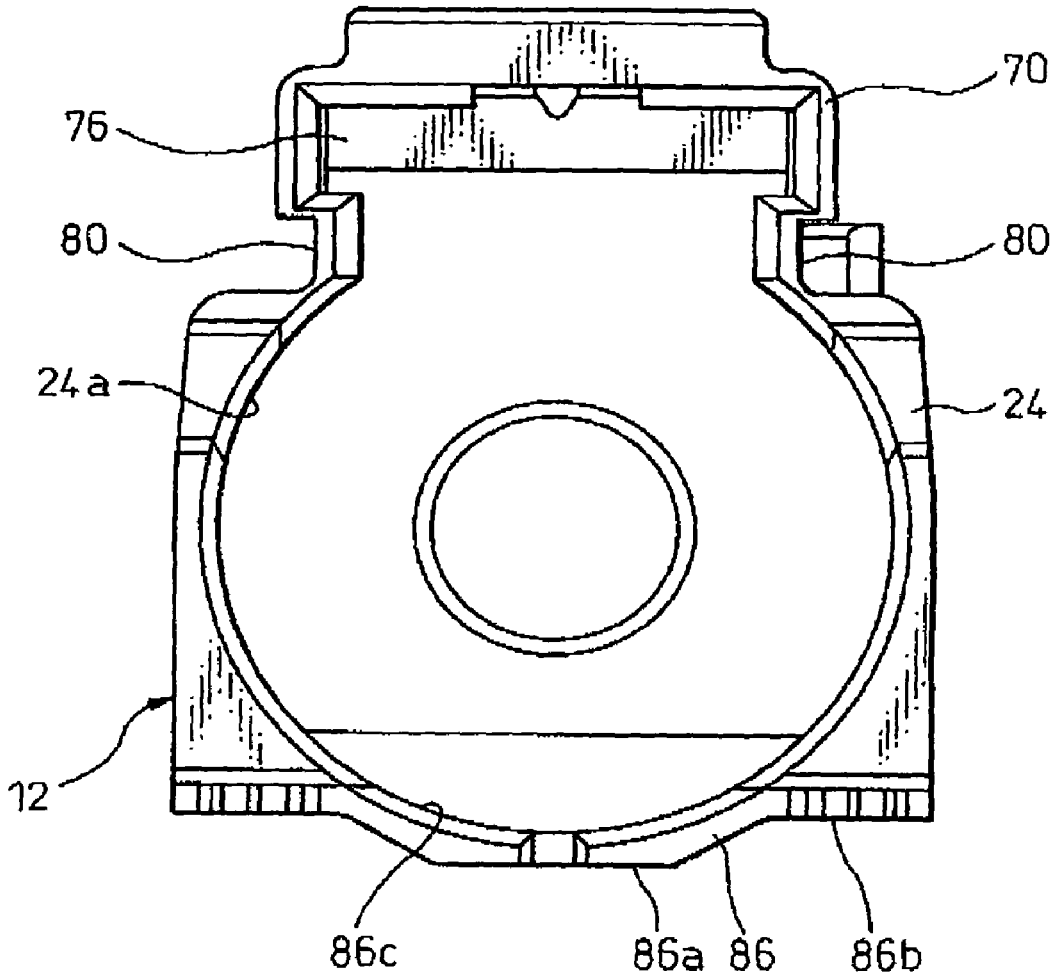
FIG. 3 is an end view of a base used in the polarized electromagnetic relay of FIG. 1.

The base 12 is formed of an electrically insulative resinous molded article, and is provided with, as an integral or unitary structure, a first portion 20 on which the electromagnet assembly 14 is disposed and a second portion 22 on which the contact section 16 is disposed (FIG. 1). The first portion 20 has a cylindrical wall 24 that surrounds a part of the electromagnet assembly 14 (FIG. 3). The second portion 22 has a plurality of mount holes (not shown) individually receiving several contact members of the contact section 16 as described later. The cylindrical wall 24 of the first portion 20 is interposed between the electromagnet assembly 14 and the contact section 16 so as to ensure electrical insulation therebetween.

The electromagnet assembly 14 includes an electromagnet 26; an armature 28 adapted to be driven by the electromagnet 26; and a permanent magnet 30 carried on the armature 28. As shown in FIG. 2, the electromagnet 26 includes a bobbin 32; a coil 34 with a center axis 34*a* wound and carried on the bobbin 32; an iron core 36 received in the bobbin 32; and a yoke 38 joined to the iron core 36 and extending outside the coil 34. The bobbin 32 is formed of an electrically insulative resinous molded article, and is provided with a hollow cylindrical body 40 having a predetermined length; and first and second flat annular collars 42 and 44 provided at longitudinally opposite ends of the body 40. The coil 34 is formed by tightly winding a required length of a conductive wire on the body 40 of the bobbin 32, and securely held between the collars 42, 44 of the bobbin 32.

The iron core 36 is a bar-shaped member made of, e.g., magnetic steel, and is provided with, as an integral or unitary structure, a cylindrical shaft portion 46 disposed along the center axis 34*a* of the coil 34 and accommodated in the body 40 of the bobbin 32, and a tabular head portion 48 extending outside of the coil 34 and radially outward from one axial end of the shaft portion 46 (FIG. 2). The head portion 48 of the iron core 36 is disposed to be exposed along an outer surface of the first collar 42 of the bobbin 32, and an outer peripheral region 48*a* of the head portion 48 protrudes slightly outward in a coil radial direction beyond the outer periphery of the first collar 42.

The yoke 38 is an L-shaped plate-like member made of, e.g., magnetic steel, and is fixedly joined to the other axial end 46*a* of the shaft portion 46 of the iron core 36, at a side opposite to the head portion 48, by, e.g., caulking, so as to form a magnetic path around the coil 34 (FIG. 2). The yoke 38 is provided with, as an integral or unitary structure, a shorter joint portion 50 joined to the shaft portion 46 of the iron core 36 and disposed along the second collar 44 of the bobbin 32, and a longer major portion 52 disposed substantially orthogonal to the joint portion 50 and extending parallel with the coil center axis 34*a* to be spaced from one lateral side of the coil 34. A distal end region 52*a* of the major portion 52 of the yoke 38 is disposed to be opposed or face to, and spaced by a predetermined distance from, the outer peripheral region 48*a* of the head portion 48 of the iron core 36, at a location laterally close to the first collar 42 of the bobbin 32.

The armature 28 includes first and second electrically conductive plate elements 54, 56 having tabular shapes identical to each other and made of, e.g., magnetic steel. The permanent magnet 30 has a rectangular parallelepiped shape, wherein N and S poles are formed on the opposite surfaces thereof involving the longest edges of parallelepiped. The first and second electrically conductive plate elements 54, 56 are disposed to be opposed to and spaced from each other, and securely hold the permanent magnet 30 therebetween in a direction of magnetization of the permanent magnet 30 (i.e., in a direction of a magnetic field created between the N and S poles as illustrated). The first and second plate elements 54, 56 are arranged to orient the magnetization direction in parallel with the center axis 34*a* of the coil 34 (FIG. 2), at a location laterally close to the first collar 42 of the bobbin 32.

The armature 28 (or the first and second electrically conductive plate elements 54, 56) cooperates with the permanent magnet 30 to constitute a magnetic movable element that moves in response to the excitation of the electromagnet 26. The magnetic movable element is arranged linearly movably in a reciprocating manner in a direction parallel with the coil center axis 34*a* (shown by an arrow $\alpha$ in FIG. 2) in a state where a part (a lower half part in the drawing) 54*a* of the first electrically conductive plate element 54 is inserted into a space defined between the outer peripheral region 48*a* of the head portion 48 of the iron core 36 and the distal end region 52*a* of the major portion 52 of the yoke 38. Therefore, a reciprocating range of the armature 28 is defined by front and rear motion limit points where the lower half part 54*a* of the first electrically conductive plate element 54 abuts respectively against the outer peripheral region 48*a* of the head portion 48 of the iron core 36 and the distal end region 52*a* of the major portion 52 of the yoke 38.

As shown in FIG. 2, the contact section 16 includes a movable contact-spring member 60 carrying a movable contact 58 adapted to operate in a manner interlocked with the force transfer member 18, a first stationary contact member 64 spaced from and opposed to one surface of the movable contact-spring member 60 and carrying a make stationary contact 62 facing the movable contact 58 in a manner enabling a mutual contact therebetween, and a second stationary contact member 68 spaced from and opposed to the other surface of the movable contact-spring member 60 at a side opposite to the first stationary contact member 64 and carrying a break stationary contact 66 facing the movable contact 58 in a manner enabling a mutual contact therebetween. The Movable contact-spring member 60 is formed by, e.g., punching a spring sheet of phosphor bronze, and exhibits a required spring biasing force correspondingly to a force applied from the force transfer member 18. The contact section 16 including these three contact members 60, 64, 68 are arranged in such a manner that the second stationary contact member 68 is disposed at a side closer to the electromagnet 26 with the cylindrical wall 24 of the base 12 interposed therebetween (FIG. 1) and the respective contacts 58, 62, 66 are aligned in a direction parallel with the center axis 34*a* of the coil 34 of the electromagnet 26.

The movable contact 58 carried on the movable contact-spring member 60 is adapted to be displaced in a rocking manner at a location above the second portion 22 of the base 12 (FIG. 1) correspondingly to the linear motion of the magnetic movable element (i.e., the armature 28 and the permanent magnet 30), so as to perform a contact opening/closing operation in relation alternately to the make stationary contact 62 and the break stationary contact 66, to which the movable contact 58 faces in a rocking direction. In this connection, the movable contact 58 is provided with a make movable contact element 58*a* adapted to contact the make stationary contact 62 and a break movable contact element 58*b* adapted to contact the break stationary contact 66 (FIG. 2).

Figure 4:
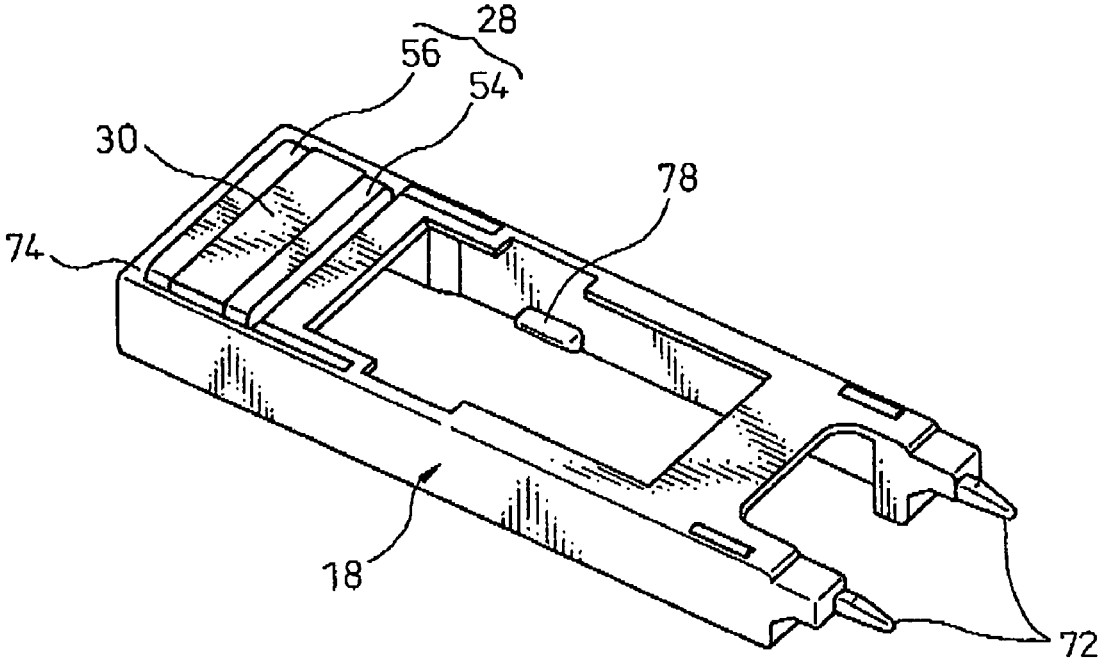
FIG. 4 is a perspective view showing a force transfer member used in the polarized electromagnetic relay of FIG. 1.

As shown in FIG. 4, the force transfer member 18 is a frame-like member having a generally rectangular shape in a plan view, and integrally molded from, e.g., a resinous material. The force transfer member 18 is supported in a longitudinally slidable manner on an upper end portion 70 of the cylindrical wall 24 of the base 12 (FIG. 3) in such a manner that a major axis of the rectangular profile of the force transfer member 18 is disposed parallel with the center axis 34*a* of the coil 34 of the electromagnet 26. A pair of force application points 72 adapted to be engaged with the movable contact-spring member 60 of the contact section 16 are provided at one longitudinal end of the force transfer member 18. Further, the armature 28 is fixedly joined to another longitudinal end region of the force transfer member 18 in a state where the permanent magnet 30 is held between the first and second electrically conductive plate elements 54, 56. In the illustrated embodiment, a cavity 74 (FIG. 1) for securely receiving the armature 28 and the permanent magnet 30 is formed in the other longitudinal end region of the force transfer member 18, and the armature 28 and the permanent magnet 30 are fixed to the cavity 74 by, e.g., press-fitting or using adhesive. When the force transfer member 18, to which the armature 28 and the permanent magnet 30 are properly fixed, is properly attached to the cylindrical wall 24 of the base 12 as well as to the movable contact-spring member 60 of the contact section 16, the armature 28, the permanent magnet 30 and the electromagnet 26 are positioned in the above-described positional correlation.

While accompanying with the above-described linear movement of the armature 28 driven by the electromagnet 26 in the direction parallel with the center axis 34*a*, the force transfer member 18 also linearly shifts in a direction parallel with the coil center axis 34*a*, so as to transfer the motion of the armature 28 to the movable contact-spring member 60 of the contact section 16, and thereby to make the contact section 16 perform an opening or closing operation. In this connection, the movable contact-spring member 60 is configured to elastically bias the movable contact 58 in a direction away from the make stationary contact 62 of the first stationary contact member 64 due to own spring effect of the movable contact-spring member 60 and, in a state where no external force is applied, to urge the movable contact 58 (or the break movable contact element 58*b*) against the break stationary contact 66 of the second stationary contact member 68 (FIG. 2).

Therefore, when the electromagnet 28 does not operate (or is not excited), the armature 28 is placed at a rest position where the lower half part 54*a* of the first electrically conductive plate element 54 is spaced away from the distal end region 52*a* of the major portion 52 of the yoke 38 and abuts against the outer peripheral region 48*a* of the head portion 48 of the iron core 36, under the spring biasing force of the movable contact-spring member 60 transferred through the force transfer member 18. In the rest position, a magnetic attractive force exerted by the permanent magnet 30 acts between the first electrically conductive plate element 54 and the head portion 48 of the iron core 36, so that the contact section 16 is securely retained at a break-contact closing position where the movable contact 58 conductively contacts the break stationary contact 66.

From the rest position, when the electromagnet 26 operates (or is excited) so as to close a make-contact pair, the armature 28 is displaced toward a first operating position where the lower half part 54*a* of the first electrically conductive plate element 54 abuts against the distal end region 52*a* of the major portion 52 of the yoke 38 and a lower half part 56*a* of the second electrically conductive plate element 56 abuts against the outer peripheral region 48*a* of the head portion 48 of the iron core 36, by synergistic magnetic-attractive force exerted by the electromagnet 26 and the permanent magnet 30 (FIG. 2). The linear displacement of the armature 28 is transferred to the movable contact-spring member 60 of the contact section 16 through the force transfer member 18 linearly shifting integrally with the armature 28. In the first operating position, the synergistic magnetic-attractive force exerted by the electromagnet 26 and the permanent magnet 30 acts between the first electrically conductive plate element 54 and the yoke major portion 52 as well as between the second electrically conductive plate element 56 and the iron core head portion 48, so that the contact section 16 is stably and securely retained at a make-contact closing position where the movable contact 58 conductively contacts the make stationary contact 62 against the spring biasing force of the movable contact-spring member 60.

If the excitation of the electromagnet is stopped in the first operating position, the armature 28 is retained at the first operating position by the action of the permanent magnet 30, and thus the contact section 16 is also securely retained at the make-contact closing position. Then, if the electromagnet 26 operates (or is excited) so as to close a break-contact pair, the armature 28 is displaced toward a second operating position where the lower half part 54*a* of the first electrically conductive plate element 54 is spaced away from the distal end region 52*a* of the major portion 52 of the yoke 38 and abuts against the outer peripheral region 48*a* of the head portion 48 of the iron core 36, by the magnetic repulsive force between the electromagnet 26 and the permanent magnet 30. During this displacement, the force transfer member 18 also acts to transfer the spring biasing force of the movable contact-spring member 60 of the contact section 16 to the armature 28. In the second operating position, the synergistic magnetic attractive force exerted by the electromagnet 26 and the permanent magnet 30 acts between the first electrically conductive plate element 54 and the iron core head portion 48, so that the contact section 16 is stably and securely retained at the break-contact closing position where the movable contact 58 conductively contacts the break stationary contact 66.

In the polarized electromagnetic relay 10 configured as described above, the electromagnet assembly 14 is configured to allow a magnetic movable element including the armature 28 and the permanent magnet 30 to linearly shift in a direction parallel with the center axis 34*a* of the coil 34 in response to the actuation of the electromagnet 26, and therefore an advantage is realized by the entire outside dimensions of the relay which can be effectively reduced in a coil radial direction. In addition, the first and second electrically conductive plate elements 54, 56 constituting the armature 28 are configured to hold the permanent magnet 30 therebetween in the magnetization direction thereof and orient the magnetization direction in parallel with the coil center axis 34*a,* and therefore the structure of the magnetic movable element formed by the armature 28 and the permanent magnet 30 can be simplified and downsized. Furthermore, the electromagnet 26 is configured to use the yoke 38, as a member separate from the iron core 36, capable of defining a desired magnetic circuit outside the coil, so as to easily ensure a space for driving the armature, where the outer peripheral region 48*a* of the head portion 48 of the iron core 36 of the electromagnet 26 and the distal end region 52*a* of the major portion 52 of the yoke 38 are opposed to and spaced from each other, at a desired position around the coil, and therefore the flexibility of the relative arrangement of the electromagnet 26 and the armature 28 can be improved. Moreover, the armature 28 is arranged linearly movably in a direction parallel with the coil center axis 34*a* in a state where the part 54*a* of the first electrically conductive plate element 54 is inserted into the space for driving the armature, and therefore the operational accuracy of the armature 28 can be ensured mainly by optimizing the shape and dimension of the first electrically conductive plate element 54. As apparent above, according to the polarized electromagnetic relay 10, all of the shifting direction of the magnetic movable element including the armature 28 and the permanent magnet 30, the magnetization direction of the permanent magnet 30, and the moving direction of the force transfer member 18 are arranged in parallel with the coil center axis 34*a,* so that the structure and driving configuration of the magnetic movable element can be simplified, and therefore the response (or operating time) of the polarized electromagnetic relay 10 can be improved and the outside dimensions and manufacturing cost can be effectively reduced.

Further, in the polarized electromagnetic relay 10 configured as described above, the armature 28 is fixedly joined to the force transfer member 18 in a state where the permanent magnet 30 is held between the first and second electrically conductive plate elements 54, 56, and therefore the force transfer member 18 can efficiently and accurately transfer the linear shifting motion of the armature 28 to the contact section 16. Moreover, the force transfer member 18, having the rectangular profile where the major axis is disposed parallel with the coil center axis 34*a,* is provided at one longitudinal end thereof with the force application point 72 for the contact section 16 and at the other longitudinal end region (i.e., cavity 74) thereof with the armature 28 secured thereto, and therefore the magnetic movable element including the armature 28 and the permanent magnet 30 can be sufficiently spaced from the contact section 16 so as to significantly reduce electrical and magnetic effects therebetween.

In the polarized electromagnetic relay 10 according to the illustrated embodiment, as shown in FIG. 2, the coil 34 of the electromagnet 26 is provided with a first outer circumferential region 34*b* located closer to the major portion 52 of the yoke 38 and a second outer circumferential region 34*c* located closer to the base 12 (FIG. 1). The force transfer member 18 is disposed shiftably along the major portion 52 of the yoke 38 at a location close to the first outer circumferential region 34*b* of the coil 34. According to this configuration, in view of spatial dimensions occupied by the polarized electromagnetic relay 10, a space for disposing the force transfer member 18 can be partially shared as a space for disposing the yoke 38 forming the magnetic circuit around the coil 34 of the electromagnet 26, and an idle space formed between the cylindrical wall 24 and the coil 34 at an interior of the cylindrical wall 24 of the base 12 can be significantly reduced. As a result, the number of windings of the coil 34 can be increased without increasing the outside dimensions of the polarized electromagnetic relay 10, and therefore the electrical characteristics of the polarized electromagnetic relay 10 can be improved.

Further, as shown in FIG. 3, the cylindrical wall 24 of the base 12 has a cylindrical inner circumferential surface 24*a* corresponding to the cylindrical profile of the coil 34 of the electromagnet 26. According to this configuration, an idle space formed between the cylindrical wall 24 of the base 12 and the coil 34 can be more effectively reduced. In this connection, as shown in the drawing, a space 76 having a rectangular cross-sectional shape for receiving the major portion 52 of the yoke 38 of the electromagnet 26 is defined at the top end portion 70 of the cylindrical wall 24 of the base 12. Further, a pair of guide grooves 80 adapted to be slidably engaged with projections 78 (FIG. 4) provided in the force transfer member 18 are formed on the cylindrical wall 24 of the base 12 adjacently to the underside of the top end portion 70. When the electromagnet assembly 14 operates, the guide grooves 80 act to guide the force transfer member 18 in a direction parallel with the coil center axis 34*a.*

Figure 5A:
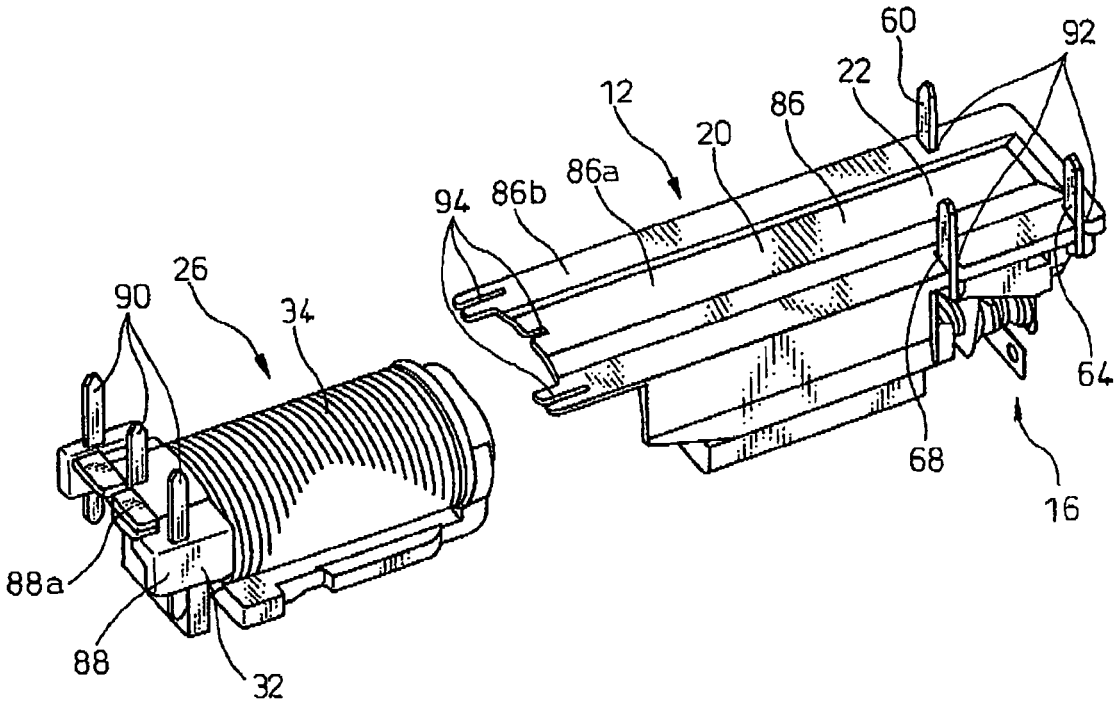
FIG. 5A is a perspective view showing several components of the polarized electromagnetic relay of FIG. 1, as seen from the back side of a base, in a state before an electromagnet is fitted to the base.
Figure 5B:
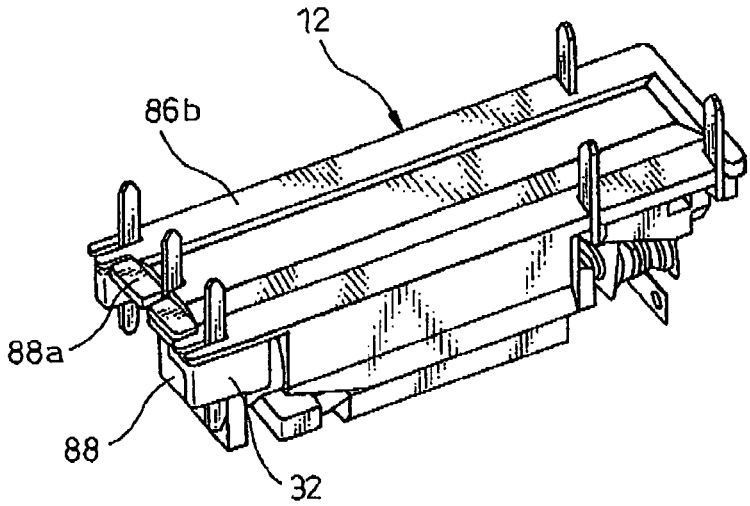
FIG. 5B is a perspective view showing the several components of FIG. 5A, in a state after the electromagnet is fitted to the base.

The polarized electromagnetic relay 10 further includes a casing 82 secured to the base 12 and accommodating the electromagnet assembly 14, the contact section 16 and the force transfer member 18 (FIG. 1). The casing 82 is formed as an electrically insulative resinous molded article having a profile of a rectangular parallelepiped, and an opening 84 for allowing the electromagnet assembly 14, the contact section 16 and the force transfer member 18 to be inserted in the casing 82 is formed at a portion corresponding to one side of the rectangular parallelepiped profile. On the other hand, the base 12 is provided with a bottom wall 86 including a bulge portion 86*a* exposed from the casing 82 and bulging outward, when the base 12 is secured to the casing 82 (FIG. 3). As shown in FIGS. 5A and 5B, the bottom wall 86 is integrally formed over the first and second portions 20, 22 of the base 12, and thus constitutes a bottom end portion of the cylindrical wall 24. A substantially flat annular surface 86*b* surrounding the bulge portion 86*a* is formed on the bottom wall 86 of the base 12, and an adhesive (not shown) for bonding the casing 82 to the base 12 is applied along the annular surface 86*b.*

Further, the bottom wall 86 of the base 12 is provided at a side opposite to the bulge portion 86*a* with a recess 86*c* formed by a part of the cylindrical inner circumferential surface 24*a* of the cylindrical wall 24 (FIG. 3). The second outer circumferential region 34*c* of the coil 34 of the electromagnet 26 is received in the recess 86*c* of the base bottom wall 86. According to this configuration, the bulge portion 86*a* provided for defining the adhesive application surface (or the annular surface) 86*b* on the base 12 can be effectively utilized so as to easily form the recess 86*c* on the cylindrical inner circumferential surface 24*a* of the cylindrical wall 24, and therefore the height of the polarized electromagnetic relay 10 can be readily reduced.

In the polarized electromagnetic relay 10 according to the illustrated embodiment, the bobbin 32 of the electromagnet 26 is further provided with an extension 88 (FIG. 1) extending outward from the first collar 42 (FIG. 2) The extension 88 of the bobbin 32 securely supports a coil terminal 90 to which a wire end of the coil 34 is connected. In the illustrated embodiment, the coil 34 includes two conductive wires (not shown), and three coil terminals 90 to which the wire ends of these two wires are connected are aligned in a direction orthogonal to the coil center axis 34*a* and supported on the extension 88 of the bobbin 32. According to this configuration, the polarized electromagnetic relay 10 is a dual-winding type that can quickly switch the mode or direction of excitation of the electromagnet 26 between a make-contact closing mode and a break-contact closing mode. It should be noted that an assembled structure formed by the bobbin 32, the coil 34 and the coil terminals 90 (i.e., the remaining components of the electromagnet 26 other than the iron core 36 and the yoke 38) is referred to as "a coil assembly" in this application.

As shown in FIGS. 5A and 5B, the bobbin 32 of the electromagnet 26 is configured such that, when the electromagnet assembly 14 is inserted into the cylindrical wall 24 of the base 12 and properly fitted to the base 12, a predetermined region 88*a* of the extension 88 cooperates with the annular surface 86*b* of the bottom wall 86 of the base 12 to provide the adhesive application surface used for bonding the casing 82 to the base 12 as described above. According to this configuration, during the adhesive application process for bonding the casing 82 to the base 12, the bobbin 32 of the electromagnet 26 can be simultaneously bounded to the base 12, and therefore the structural stability of the polarized electromagnetic relay 10 can be improved without increasing the number of manufacturing steps. In this connection, as shown in FIGS. 5A and 5B, three mount holes 92, to which the contact members 60, 64 and 68 of the contact section 16 are respectively mounted, and three support holes 94, into which the coil terminals 90 are respectively inserted, are formed at predetermined positions of the bottom wall 86 of the base 12.

Figure 6:
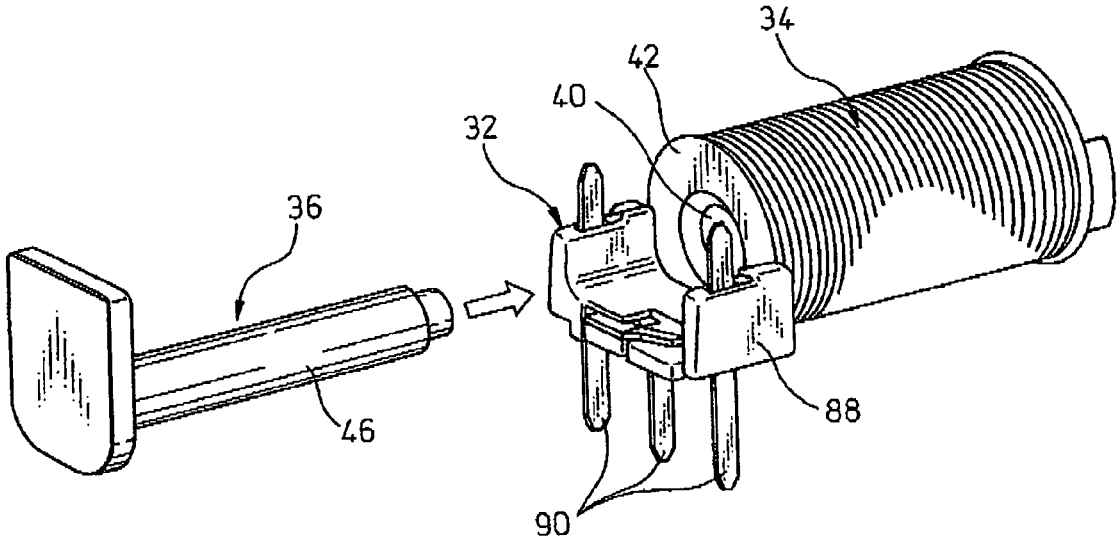
FIG. 6 is an exploded perspective view for explaining an assembling operation of the polarized electromagnetic relay of FIG. 1.
Figure 7A:
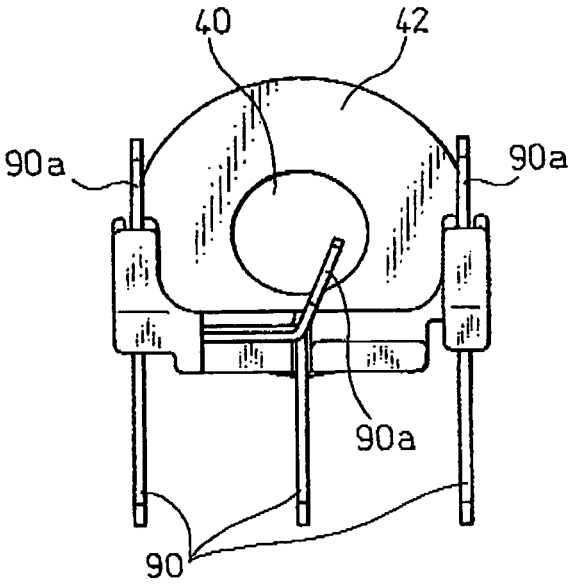
FIG. 7A is an end view of several component of the polarized electromagnetic relay of FIG. 1, showing a state during a tying operation of a wire end of a coil.
Figure 7B:
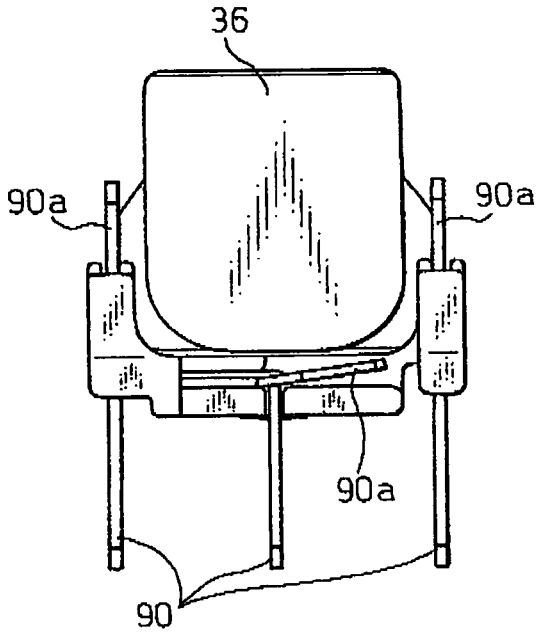
FIG. 7B is an end view of the several component of FIG. 7A, showing a state after the wire-end tying operation is completed.

In the polarized electromagnetic relay 10 configured as described above, when the electromagnet 26 is assembled, as shown in FIG. 6, the coil 34 is mounted on the bobbin 32 and the wire ends of the coil 34 are tied to the coil terminals 90, and thereafter the shaft portion 46 of the iron core 36 is inserted into the body 40 from the side of the first collar 42 of the bobbin 32. In order to enable this assembling operation, when the wire of the coil 34 is tied to the coil terminal 90, tying portions 90*a* of the three coil terminals 90 are disposed at generally upright positions to ease the tying operation (FIG. 7A). After the tying operation is completed, the tying portion 90*a* of the center coil terminal 90 is bent to a shape capable of avoiding the shaft portion 46 on the extension 88 of the bobbin 32, before the iron core 36 is fitted to the bobbin 32 (FIG. 7B). As a result, the shaft portion 46 of the iron core 36 can be inserted into the body 40 of the bobbin 32, While a preferred embodiment of the polarized electromagnetic relay according to the present invention has been described, the present invention is not limited to the above embodiment and other various modifications may be made.

Figure 8:
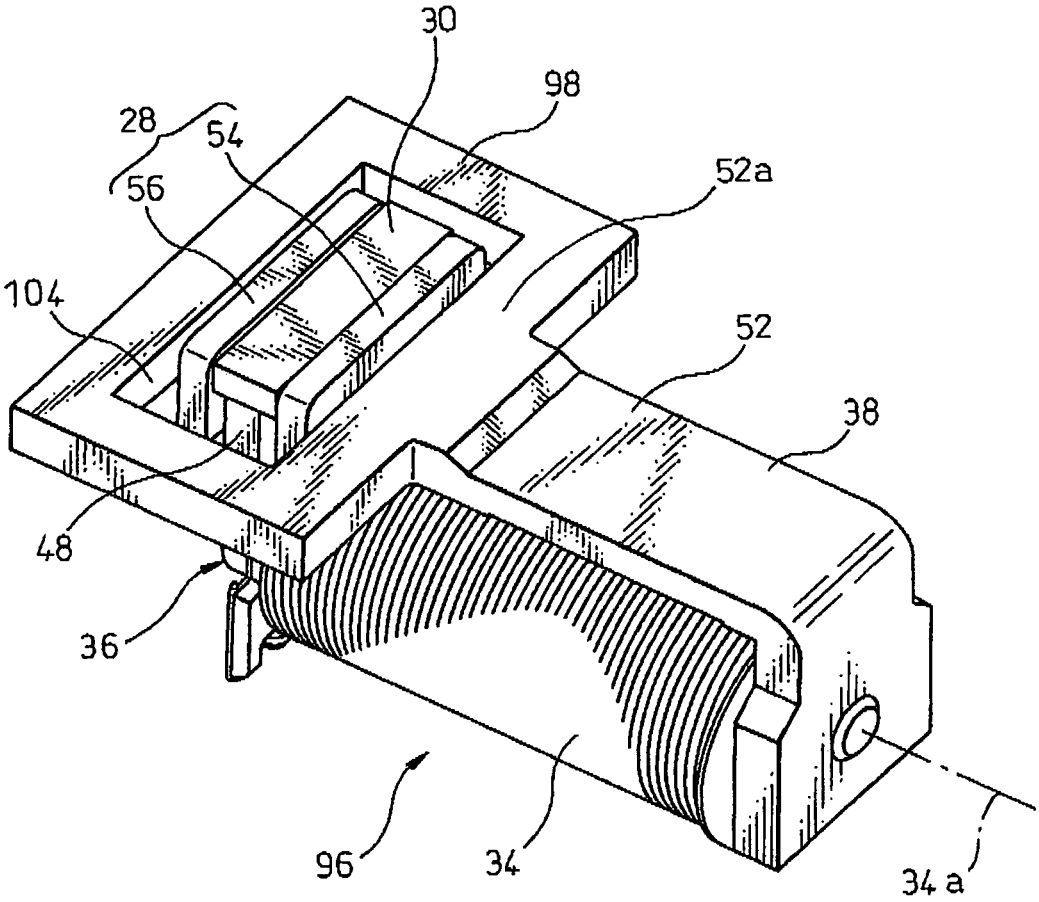
FIG. 8 is a perspective view of a modification of an electromagnet, which can be used in the polarized electromagnetic relay of the present invention.

For example, FIG. 8 shows one modification of an electromagnet 96 that can be installed on a polarized electromagnetic relay according to the present invention. The electromagnet 96 has a configuration obtained by somewhat modifying the structure of the yoke 38 in the electromagnet 26 of the polarized electromagnetic relay 10 described above, and therefore corresponding components are denoted by like reference numerals and descriptions thereof are not repeated.

The electromagnet 96 is configured such that the distal end region 52*a* of the major portion 52 of the yoke 38 is provided with an annular portion 98 surrounding, through a required gap, a magnetic movable element in which the permanent magnet 30 is held between the first and second electrically conductive plate elements 54, 56 of the armature 28. In this configuration, parts 54*a*, 54*b* (FIG. 2) of the first and second electrically conductive plate elements 54, 56 are respectively inserted into spaces defined at opposite sides of the head portion 48 of the iron core 36 between the outer peripheral region 48*a* (FIG. 2) of the head portion 48 and the annular portion 98 of the distal end region 52*a*. In this state, the armature 28 can linearly shift in the direction parallel with the center axis 34*a* of the coil 34 in response to the operation of the electromagnet 96 as described above. According to this configuration, the magnetic effects of both the electromagnet 96 and the permanent magnet 30 equally act to the first and second electrically conductive plate elements 54, 56, and therefore the linear shifting motion of the armature 28 to make the contact section 16 open ox close is balanced between the make-contact closing direction and the break-contact closing direction. As a result, particularly for a signal switching use, reliability and accuracy of the operation of the polarized electromagnetic relay can be improved.

Figure 9:
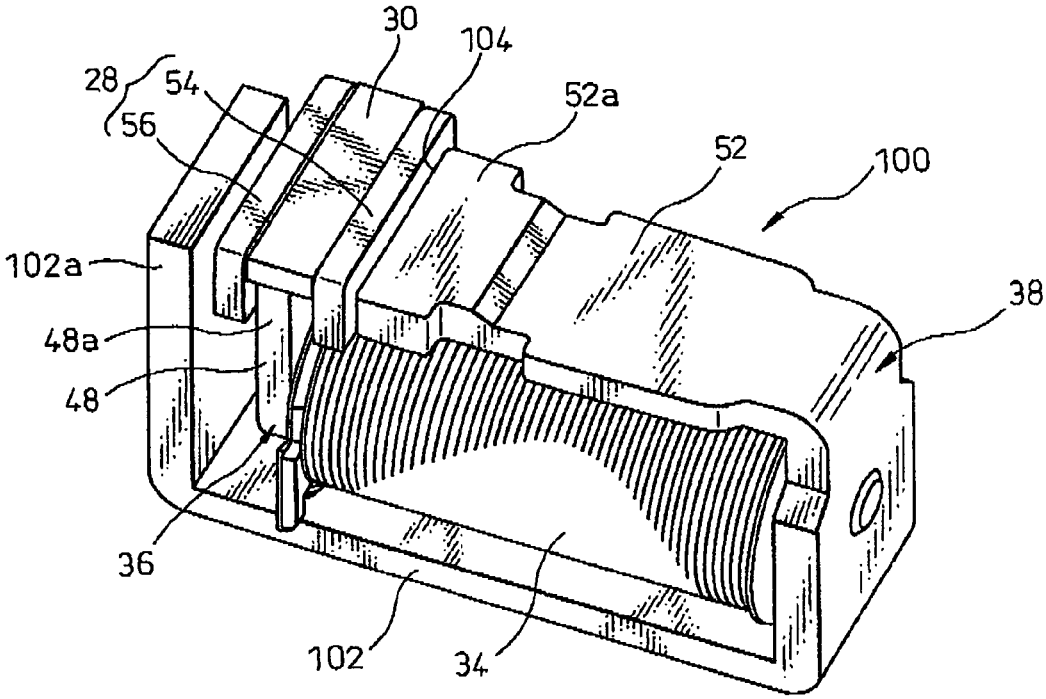
FIG. 9 is a perspective view of another modification of an electromagnet.
Figure 10:
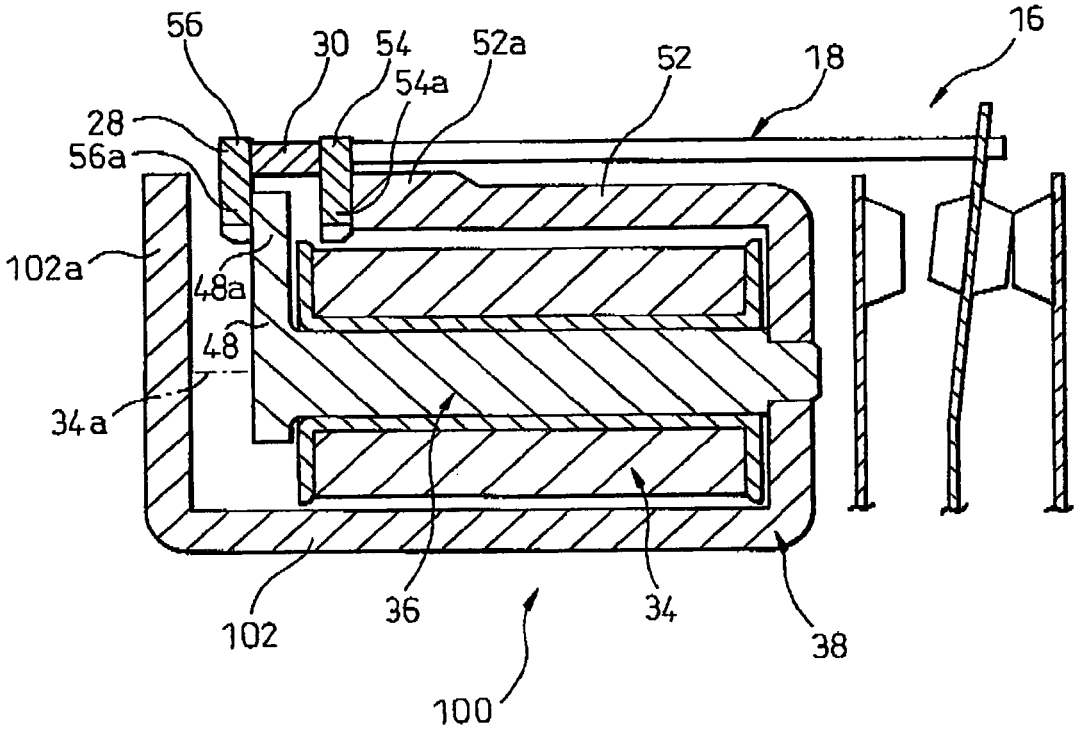
FIG. 10 is a sectional view showing several components including the electromagnet of FIG. 9, correspondingly to FIG. 2.

FIGS. 9 and 10 show another modification of an electromagnet 100 that can be installed in a polarized electromagnetic relay according to the present invention. The electromagnet 100 has a configuration obtained by somewhat modifying the structure of the yoke 38 in the electromagnet 26 of the polarized electromagnetic relay 10 described above, and therefore corresponding components are denoted by like reference numerals and descriptions thereof are not repeated.

In the electromagnet 100, the major portion 52 of the yoke 38 is disposed close to the force transfer member 18 at one lateral side of the coil 34, and the yoke further includes a secondary portion 102 disposed oppositely to the major portion 52 and close to the base 12 (FIG. 1) at the other lateral side of the coil 34, the secondary portion 102 extending generally parallel with the coil center axis 34*a*. The secondary portion 102 of the yoke 38 is bent into an L-shape and is provided with a distal end region 102*a* extending at a location axially outside of the head portion 48 of the iron core 36 to be spaced from and opposed to the head portion 48. Then, the armature 28 is disposed so that the part 54*a* of the first electrically conductive plate element 54 is inserted into a space defined between the outer peripheral region 48*a* of the iron core head portion 48 and the distal end region 52*a* of the yoke major portion 52 and the part 56*a* of the second electrically conductive plate element 56 is inserted into a space defined between the outer peripheral region 48*a* of the iron core head portion 48 and the distal end region 102*a* of the yoke secondary portion 102. In this state, the armature 28 can linearly move in the direction parallel with the center axis 34*a* of the coil 34 in response to the operation of the electromagnet 100 as described above. Also in this configuration, the linear movement of the armature 28 to make the contact section 16 open or close can be balanced between the make-contact closing direction and the break-contact closing direction.

In the embodiment and its modifications described above, the distal end region 52*a* of the major portion 52 of the yoke 36 is provided with a sheared surface 104 resulting from forming the yoke 38 by a stamping process (FIGS. 1, 8 and 9). Then, a part of at least one of the first and second electrically conductive plate elements 54, 56 of the armature 28 is disposed to face to, and be able to abut against, the sheared surface 104 of the distal end region 52*a*. According to this configuration, the polarized electromagnetic relay according to the present invention can more effectively reduce the outside dimensions of the relay, in particular, in its entirety as seen in the coil radial direction.

FIGS. 11A to 14B show another embodiment of a coil assembly 110 that can be used in a polarized electromagnetic relay according to the present invention. In the polarized electromagnetic relay 10 according to the embodiment described above, the coil assembly in the electromagnet 26 includes the bobbin 32 on which the coil 34 is wound, and three coil terminals 90 fixedly supported on the bobbin 32, the wire forming the coil 34 being respectively connected to the coil terminals 90 (FIG. 6). The coil 34 constitutes two excitation circuits, each of which includes a terminal pair defined by any two coil terminals 90 of the three coil terminals 90, and therefore the polarized electromagnetic relay 10 can quickly switch between an operating state (i.e., a make-contact closing state) and a reset state (i.e., a break-contact closing state) and in either state, the contact section 16 can be stably kept in the closed contact state.

In this connection, the coil assembly 110 shown in FIGS. 11A to 14B does not only have, a basic configuration similar to that of the coil assembly of the electromagnet 26 described above, but also has a characteristic configuration described below so as to safely and accurately perform an operation for automatically connecting the conductive wire of the coil to each of three coil terminals. It should be noted that the coil assembly 110 can be incorporated into the electromagnet 26 in place of the coil assembly (FIG. 6) of the polarized electromagnetic relay 10 according to the embodiment described above, so that a polarized electromagnetic relay (not shown) according to another embodiment of the present invention is provided.

Figure 11A:
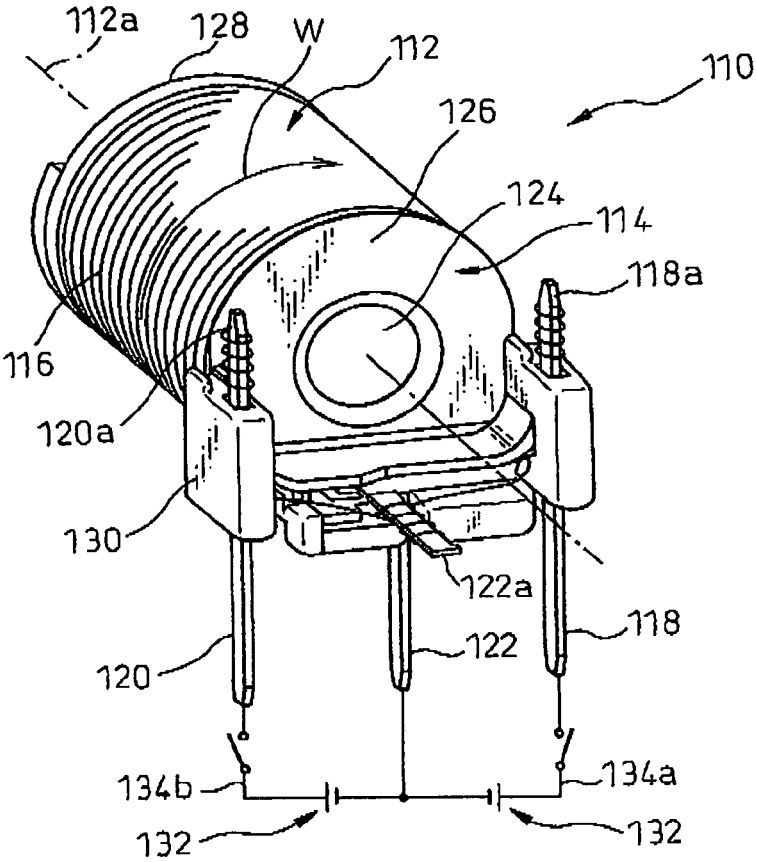
FIG. 11A is a perspective view showing an upper side of a-coil assembly according to an embodiment of the present invention.
Figure 11B:
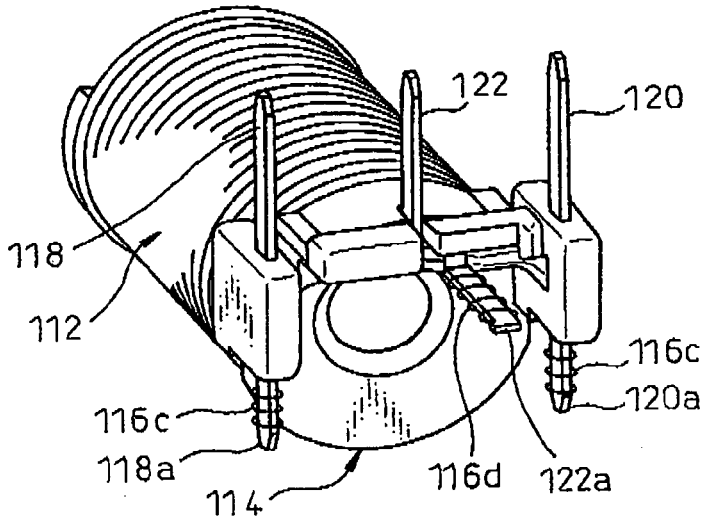
FIG. 11B is a perspective view showing a lower side of the coil assembly of FIG. 11A.
Figure 12:
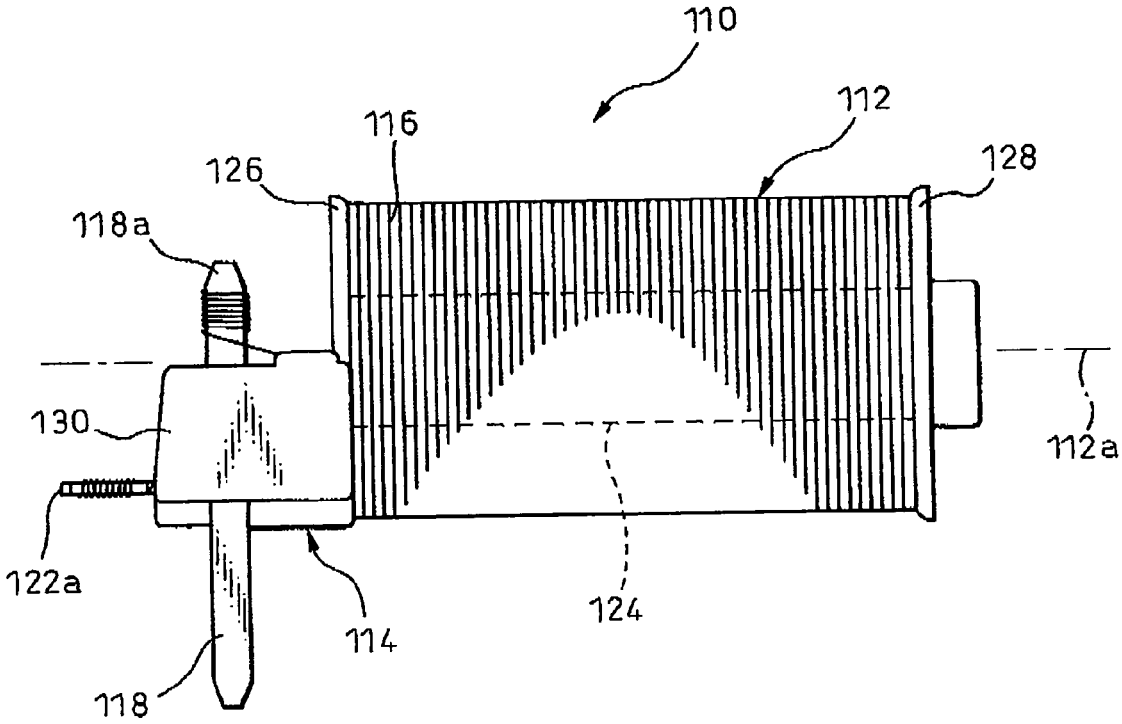
FIG. 12 is a front view of the coil assembly of FIG. 11.
Figure 13A:
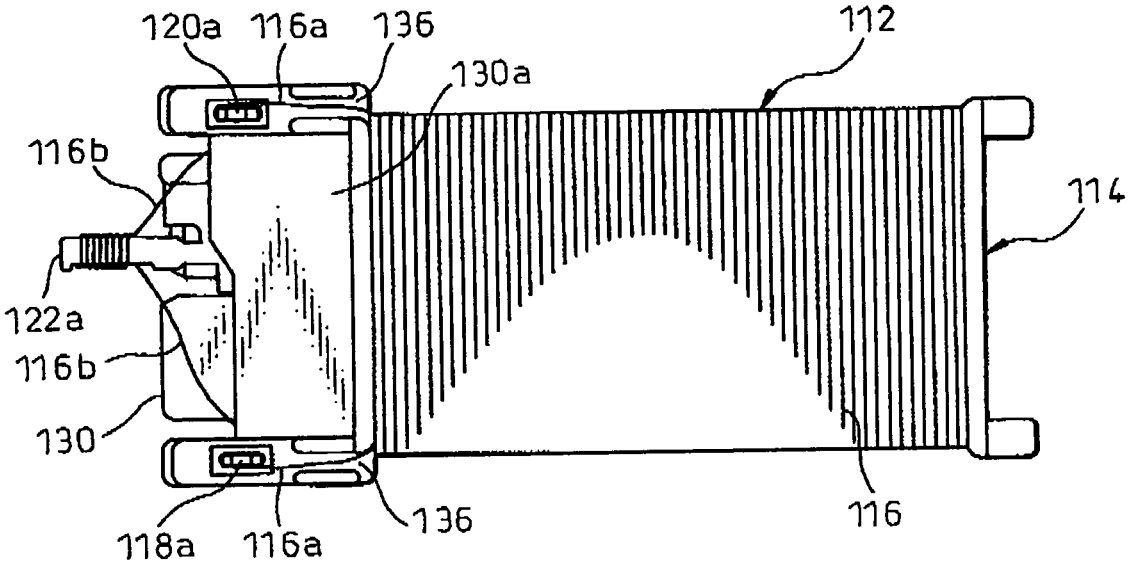
FIG. 13A is a top plan view of the coil assembly of FIG. 12.
Figure 13B:
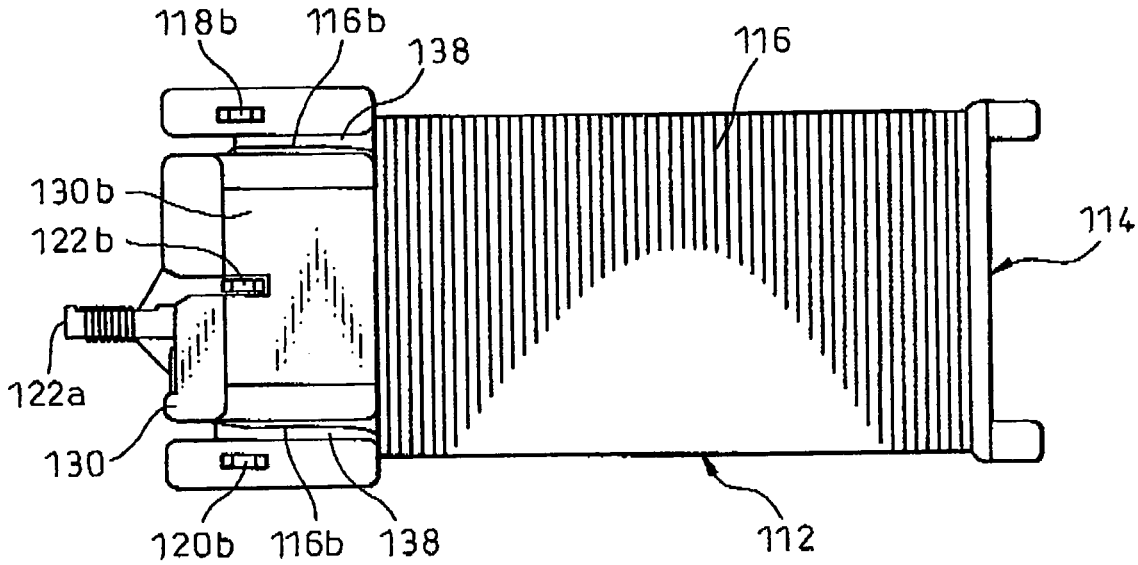
FIG. 13B is a bottom view of the coil assembly of FIG. 12.
Figure 14A:
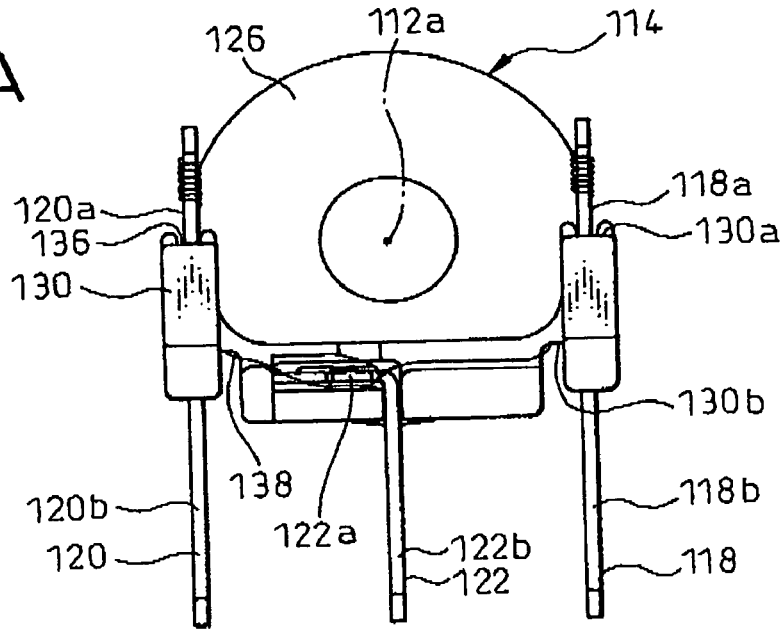
FIG. 14A is a left side view of the coil assembly of FIG. 12.
Figure 14B:
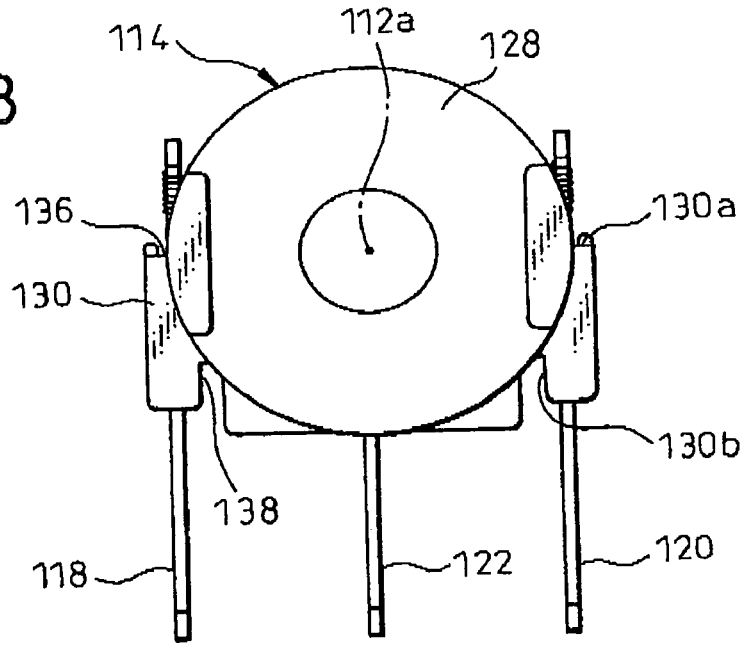
FIG. 14B is a right side view of the coil assembly of FIG. 12.
Figure 15:
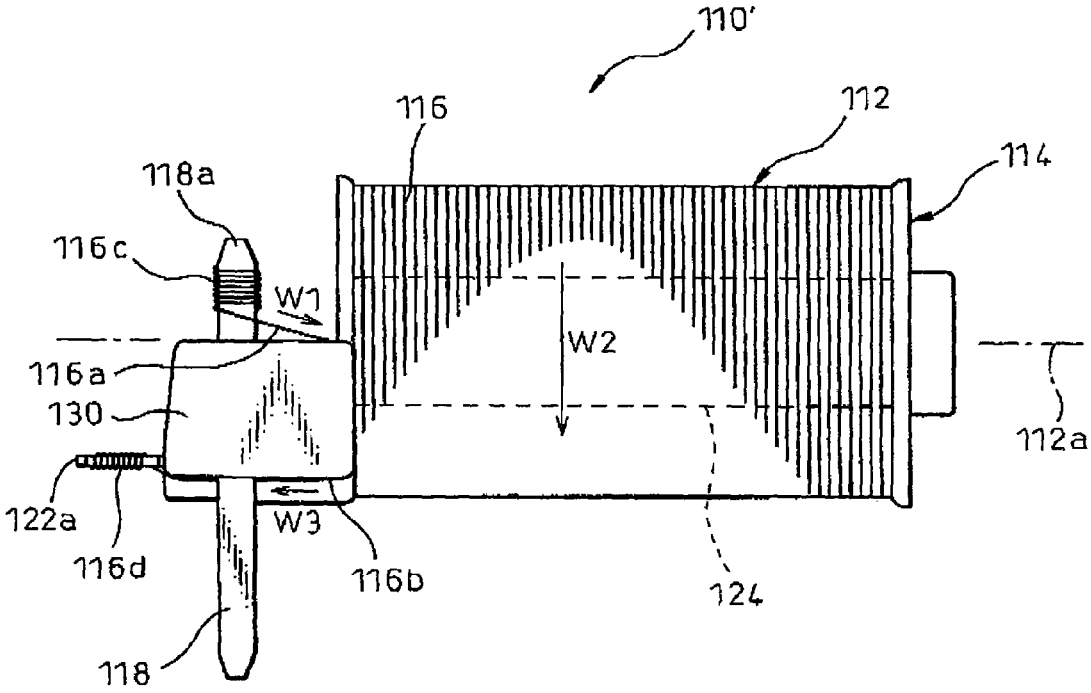
FIG. 15 is a front view of a modified coil assembly.
Figure 16A:
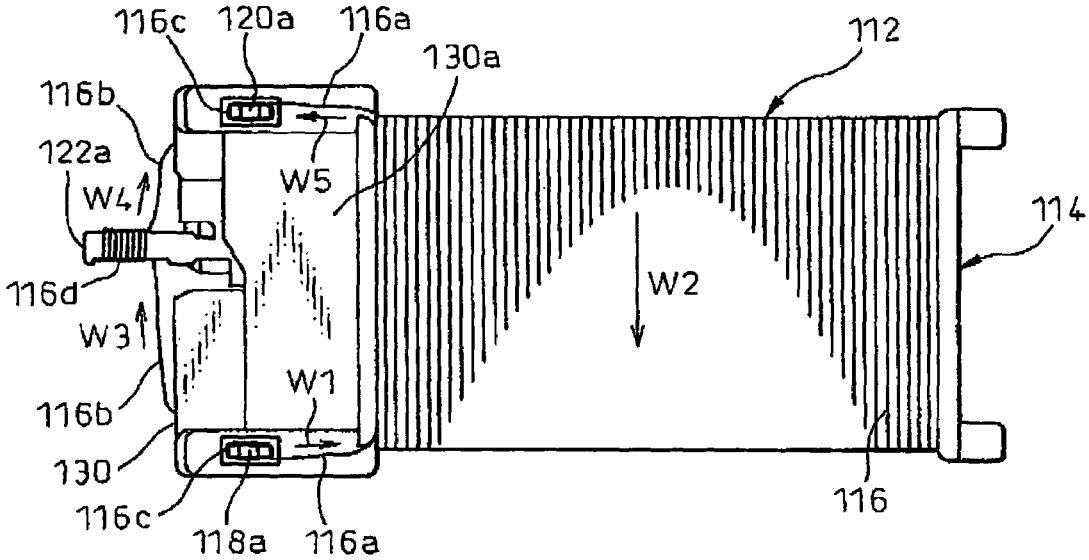
FIG. 16A is a top plan view of the coil assembly of FIG. 15.
Figure 16B:
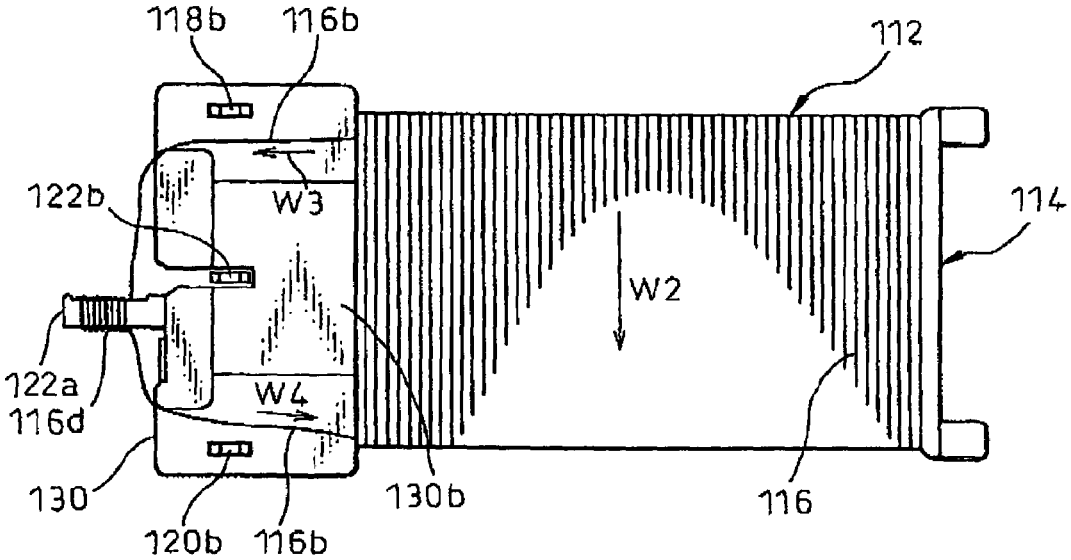
FIG. 16B is a bottom view of the coil assembly of FIG. 15.
Figure 17A:
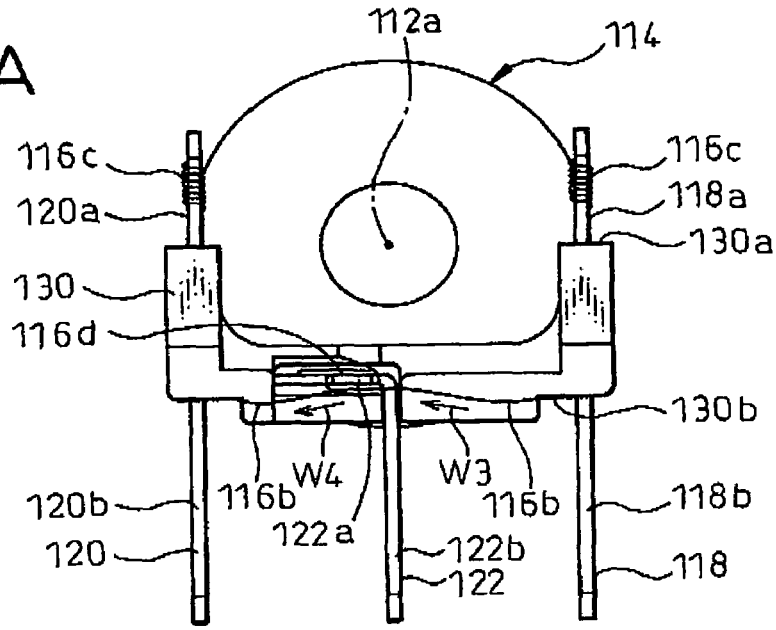
FIG. 17A is a left side view of the coil assembly of FIG. 15.
Figure 17B:
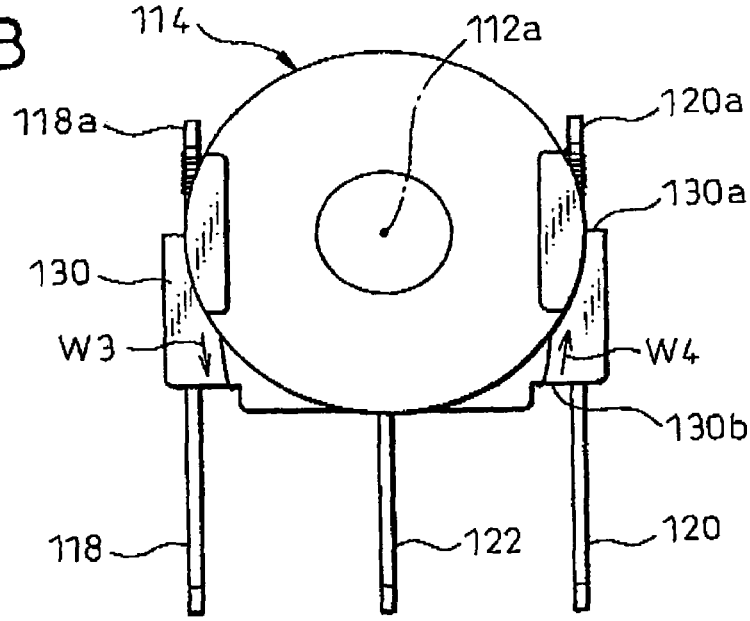
FIG. 17B is a right side view of the coil assembly of FIG. 15.

The coil assembly 110 includes a coil 112 with a center axis 112*a;* a bobbin 114 on which the coil 112 is wound; and three coil terminals 118, 120 and 122 securely supported on the bobbin 114, a conductive wire 116 forming the coil 112 being connected to each coil terminal (FIGS. 11A and 11B). Similarly to the above-described bobbin 32, the bobbin 114 is provided with a hollow cylindrical body 124; first and second flat annular collars 126 and 128 provided at longitudinally opposite ends of the body 124; and an extension 130 extending outward from the first collar 126 (FIG. 12). The coil 112 is formed by tightly winding a required length of the wire 116 on the body 124 of the bobbin 114, and securely held between the collars 126, 128 of the bobbin 114.

The coil 112 constitutes two excitation circuits, each of which includes a terminal pair defined by any two coil terminals of the three coil terminals 118, 120, 122. In the illustrated embodiment, the three coil terminals 118, 120, 122 are generally equidistantly aligned in a direction orthogonal to the coil center axis 112*a* on the extension 130 of the bobbin 114. As illustrated, a coil power supply 132 is connected in a switchable manner to the first and second coil terminals 118, 120 at opposite ends in an aligning direction as well as the third coil terminal 122 at the center in the aligning direction, so that the first and third coil terminals 118, 122 constitute a terminal pair of one excitation circuit 134*a* and the second and third coil terminals 120, 122 constitute a terminal pair of the other excitation circuit 134*b* (FIG. 11A). These excitation circuits 134*a*, 134*b* are configured to excite the electromagnet including the coil assembly 110 in a make-contact closing direction and a break-contact closing direction, respectively, and, in the illustrated configuration, the wire 116 of the coil 112 is wound in an identical direction W in either, excitation circuits 134*a*, 134*b*.

Each of three coil terminals 118, 120, 122 has a tying portion 118*a*, 120*a*, 122*a*, to which the wire 116 is connected, and a termination portion 118*b*, 120*b*, 122*b* defined away from the tying portion 118*a*, 120*a*, 122*a*, wherein the tying portion 118*a*, 120*a*, 122*a* and the termination portion 118*b*, 120*b*, 122*b* are disposed to protrude outside the bobbin 114 (FIGS. 13A to 14B). The bobbin 114 is provided with a first surface (or a first surface 130*a* of the extension 130, in the drawing) defining a side from which the tying portion (the tying portions 118*a*, 120*a*, in the drawing) of one coil terminal (the first and second coil terminals 118, 120, in the drawing) of the terminal pair in each of two excitation circuits 134*a*, 134*b* protrudes, and a second surface (or a second surface 130*b* of the extension 130, in the drawing) defining another side opposite to the first surface and from which the termination portion (the termination portions 118*b*, 120*b*, in the drawing) of the one coil terminal protrudes.

More specifically, in the illustrated embodiment, the first and second coil terminals 118, 120 are respectively provided at one ends thereof with the tying portions 118*a*, 120*a* protruding from the first surface 130*a* of the extension 130 of the bobbin 114 in a direction generally orthogonal to the coil center axis 112*a*, and at the other ends thereof with the termination portions 118*b*, 120*b* protruding from the second surface 130*b* of the extension 130 in a direction generally orthogonal to the coil center axis 112*a*. The first and second coil terminals 118, 120 are disposed on the extension 130 in such a manner that the tying portions 118*a*, 120*a* are in parallel with each other and the termination portions 118*b*, 120*b* are also in parallel with each other. On the other hand, the third coil terminal 122 is provided at one end thereof with the tying portion 122*a* protruding from the extension 130 of the bobbin 114 in a direction generally parallel with the coil center axis 112*a*, and at the other end thereof with the termination portion 122*b* protruding from the second surface 130*b* of the extension 130 in a direction generally orthogonal to the coil center axis 112*a*. The third coil terminal 122 is disposed on the extension 130 in such a manner that the termination portion 122*b* is in parallel with the termination portions 118*b*, 120*b* of the first and second coil terminals 118, 120. Due to this terminal configuration, the automatic winding process as described later and using a known winding machine can be smoothly performed.

The wire 116 of the coil 112 is provided with a pair of predetermined lengths (each referred to as a first lead portion, in this application) 116*a*, each of which extends between the coil 112 and the tying portion (the tying portions 118*a*, 120*a*, in the drawing) of one coil terminal (the first and second coil terminals 118, 120, in the drawing) of the terminal pair of each of two excitation circuits 134*a*, 134*b*, and a pair of predetermined lengths (each referred to as a second lead portion, in this application) 116*b*, each of which extends between the coil 112 and the tying portion (the tying portion 122*a*, in the drawing) of the other coil terminal (the third coil terminal 122, in the drawing) of the terminal pair. In the coil assembly 110, the wire 116 of the coil 112 is configured so that the first lead portions 116*a* are laid along the first surface (the first surface 130*a* of the extension 130, in the drawing) of the bobbin 114 at a side closer to the center axis 112*a* of the coil 112, and the second lead portions 116*b* are laid along the second surface (the second surface 130*b* of the extension 130, in the drawing) of the bobbin 114 at a side away from the coil center axis 112*a* (FIGS. 13A to 14B).

In the coil assembly 110 configured as described above, the pair of the first lead portions 116*a* and the pair of the second lead portions 116*b* of the wire 116, extending between the individual coil terminals 118, 120, 122 and the coil 112, are laid respectively along the first and second surfaces 130*a*, 130*b* of the extension 130 of the bobbin 114 without intersecting or contacting each other, and therefore it is possible to prevent the first and second lead portions 116*a*, 116*b* from causing a wire breakage and/or a layer short due to insulation-coating deterioration, which may otherwise be caused by friction between the wires. Therefore, according to the coil assembly 110, an automatic winding process for connecting the wire 116 to each of three coil terminals 118, 120, 122 and thus forming the coil 112 on the bobbin 114 can be safely and accurately performed. Further, due to the fact that the automatic winding process can be safely and accurately performed, a polarized electromagnetic relay (e.g., the polarized electromagnetic relay 10) including an electromagnet (e.g., the electromagnet 26, 96, 100) incorporating the coil assembly 110 therein possesses excellent reliability.

In the illustrated embodiment, the extension 130 of the bobbin 114 is provided on the first surface 130*a* with a pair of guide grooves 136 spaced from each other and adjacent to respective areas from which the tying portions 118*a*, 120*a* of the first and second coil terminals 118, 120 protrude, and on the second surface 130*b* with a pair of guide grooves 138 spaced from each other and adjacent to respective areas from which the termination portions 118*b*, 120*b* of the first and second coil terminals 118, 120 protrude (FIGS. 13A to 14B). The guide grooves 136 and 138 receive the first and second lead portions 116*a*, 116*b* of the wire 116 and retain them in a properly laid form capable of eliminating the intersection and/or contact therebetween, and therefore the accuracy and reliability of the automatic winding process can be improved.

On the other hand, provided that the accuracy and reliability of the automatic winding process can be sufficiently ensured, the guide grooves 136, 138 of the bobbin 114 described above may be omitted. FIGS. 15 to 17B show a modified coil assembly 110' that includes a bobbin with no guide groove. The coil assembly 110' according to this modification has a configuration substantially identical to that of the coil assembly 110 described above, except that the bobbin 114 has no guide groove for receiving the first and second lead portions 116*a*, 116*b* of the wire 116, and therefore corresponding components are denoted by like reference numerals and descriptions thereof are not repeated.

In the coil assemblies 110, 110' described above, the first to third coil terminals 118, 120, 122 are generally equidistantly aligned in the direction orthogonal to the coil center axis 112*a* and the center third coil terminal 122 is shared by two excitation circuits 134*a*, 134*b*, so that the coil 112 can be formed entirely by a single continuous wire 116, wherein the opposite wire ends 116*c* of the wire 116 are connected respectively with the first and second coil terminals 118, 120 and an intermediate point 116*d* of the wire 116 is connected with the third coil terminal 122 (FIG. 11B). Also in this case, the first and third coil terminals 118, 122 act as a terminal pair of one excitation circuit 134*a* and the second and third coil terminals 120, 122 act as a terminal pair of the other excitation circuit 134*b* (FIG. 11A). According to this configuration, the automatic winding process for forming the coil 112 by using the wire 116 can be performed more quickly, and therefore the manufacturing costs of the coil assembly 110, 110' (or of the polarized electromagnetic relay using the coil assembly 110, 110') can be reduced. In this connection, also in the electromagnet 26, 96, 100 of the polarized electromagnetic relay 10 shown in FIGS. 1 to 10, equivalent effects can be obtained by forming the coil 34 in its entirety by a single continuous wire.

An example of the automatic winding process of the wire 116 in the coil assembly 110, 110', in which the coil 112 is entirely formed by the single continuous wire 116, will be described with reference to FIGS. 15 to 17B. As a preparation work, three coil terminals 118, 120, 122 are fixed to the predetermined positions on the bobbin 114, and an automatic winding machine (not shown) is set to a task preparation state. It should be understood that the operation steps described below are performed as automatic operations by the automatic winding machine, unless otherwise noted.

First, the wire end 116*c* of the wire 116 is tied and temporarily secured to the tying portion 118*a* of the first coil terminal 118. Next, the first lead portion 116*a* of the wire 116 adjacent or subsequent to the wire end 116*c* is laid along the first surface 130*a* (or in the guide groove 136 (FIG. 13A, if present) of the extension 130 of the bobbin 114 (shown by an arrow W1); and a predetermined length of the wire 116 adjacent or subsequent to the first lead portion 116 is wound around the body 124 of the bobbin 114 (shown by an arrow W2). After the predetermined length of the wire 116 is wound by a certain number of turns required for one excitation circuit 134*a* (FIG. 11A), the second lead portion 116*b* of the wire 116 adjacent or subsequent to the predetermined length is laid along the second surface 130*b* (or in the guide groove 138 (FIG. 13B), if present) of the extension 130 of the bobbin 114 (shown by an arrow W3), and the intermediate point 116*d* of the wire 116 adjacent or subsequent to the second lead portion 116*b* is tied and temporarily secured to the tying portion 122*a* of the third coil terminal 122. As a result, a coil part constituting one excitation circuit 134*a* is formed and temporarily retained on the body 124 of the bobbin 114.

Next, another second lead portion 116*b* of the wire 116 adjacent or subsequent to the intermediate point 116*d* is laid along the second surface 130*b* (or in the guide groove 138 (FIG. 13B), if present) of the extension 130 of the bobbin 114 in a direction toward the second coil terminal 120 (shown by an arrow W4), and another predetermined length of the wire 116 adjacent or subsequent to the second lead portion 116*b* is additionally wound around the coil part temporarily retained on the body 124 of the bobbin 114 (shown by an arrow W2). After the predetermined length of the wire 116 is wound by a certain number of turns required for another excitation circuit 134*b* (FIG. 11A), another first lead portion 116*a* of the wire 116 adjacent or subsequent to the predetermined length is laid along the first surface 130*a* (or in the guide groove 136 (FIG. 13A), if present) of the extension 130 of the bobbin 114 (shown by an arrow W5), and another wire end 116*c* of the wire 116 adjacent or subsequent to the first lead portion 116*a* is tied and temporarily secured to the tying portion 120*a* of the second coil terminal 120. As a result, a coil part constituting the other excitation circuit 134*b* is formed and temporarily retained on the body 124 of the bobbin 114. Finally, the opposite wire ends 116*c* and intermediate point 116*d* of the wire 116, which have been temporarily secured to the tying portions 118*a*, 120*a*, 122*a* of the first to third coil terminals 118, 120, 122, are permanently fixed by, e.g., welding, and thereby the automatic winding process is completed.

In the illustrated embodiment, the pair of second lead portions 116*b* of the wire 116 extend toward the first and second coil terminals 118, 120 in a direction away from each other when viewed from the tying portion 122*a* of the third coil terminal 122. However, the laying configuration is not limited to this embodiment, and the pair of second lead portions 116*b* may be laid to extend in a direction similar to each other between the coil 112 and the tying portion 122*a* of the third coil terminal 122 (in particular, in the case where the guide groove 138 is not provided). Also in this case, from the viewpoint of preventing the second lead portions 116*b* from being damaged, it is important to lay the pair of second lead portions 116*b* so as not to contact each other.

In the coil assembly 110, 110', instead of forming the entire coil 112 by the single continuous wire 116, the coil 112 may be formed by respectively using conductive wires different from each other for the two excitation circuits 134*a*, 134*b* (FIG. 11A). In this configuration, even though it is somewhat disadvantage in terms of manufacturing costs, there is an advantage such that, for example, in the automatic winding process described above, the coil part for the excitation circuit 134*a*, which is disposed radially inward on the body 124 of the bobbin 114, and the coil part for the excitation circuit 134*b*, which is disposed radially outward on the body 124, may be formed by the wires having diameters different from each other, so that an operational efficiency of the winding process can be equalized for the both coil parts. As a result of the equalization of the winding efficiency between the excitation circuits 134*a*, 134*b* for exciting the electromagnet in the make-contact closing direction and the break-contact closing direction, the response and/or speed of the contact section can be equalized for the make-contact closing operation and the break-contact closing operation.

Figure 18:
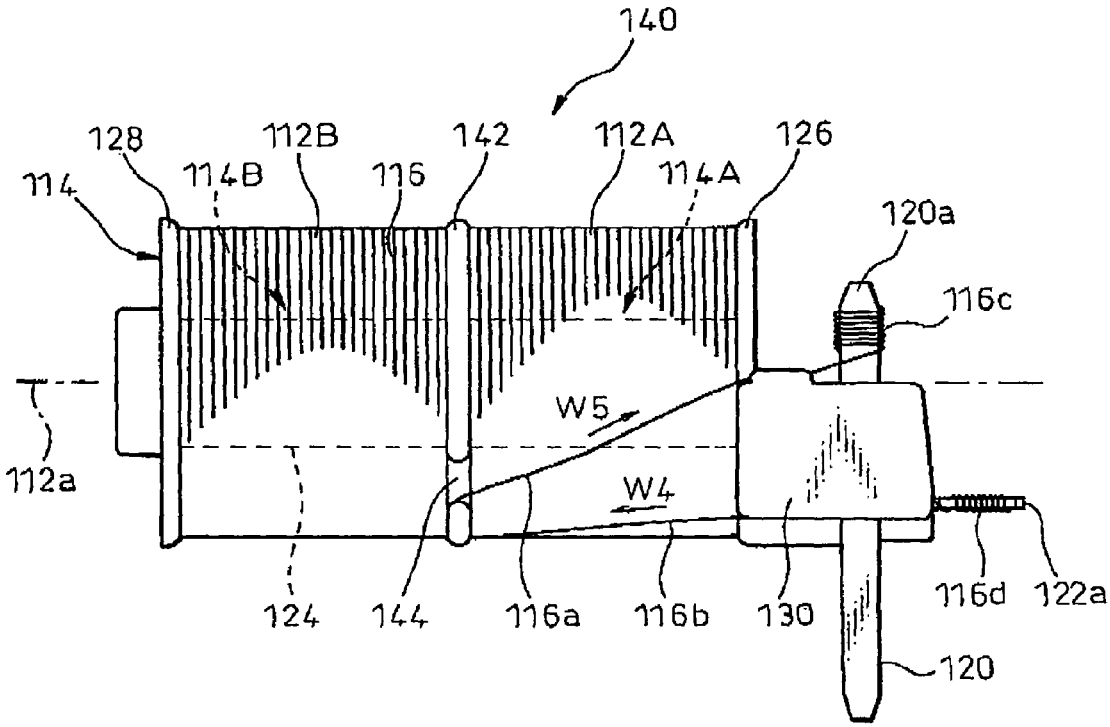
FIG. 18 is a front view of a coil assembly according to another embodiment of the present invention.
Figure 19A:
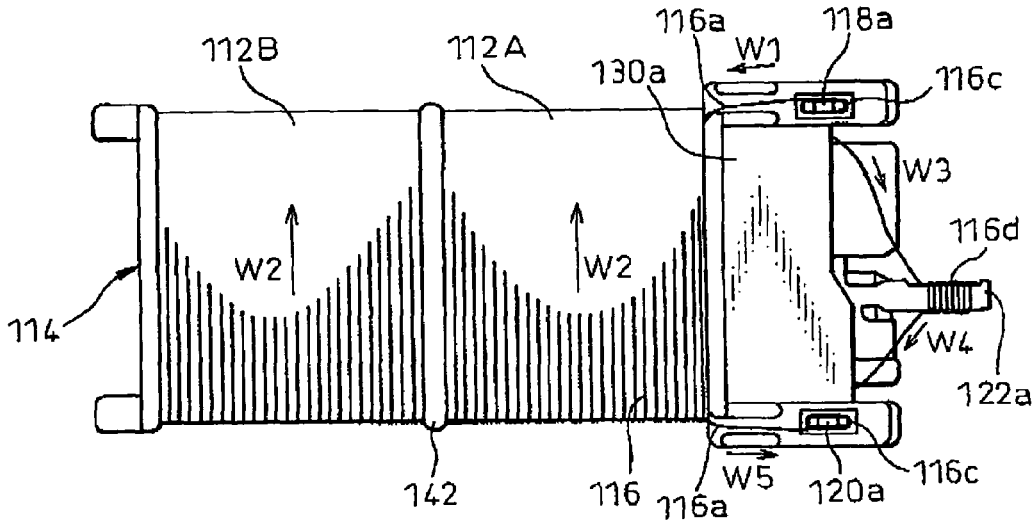
FIG. 19A is a top plan view of the coil assembly of FIG. 18.
Figure 19B:
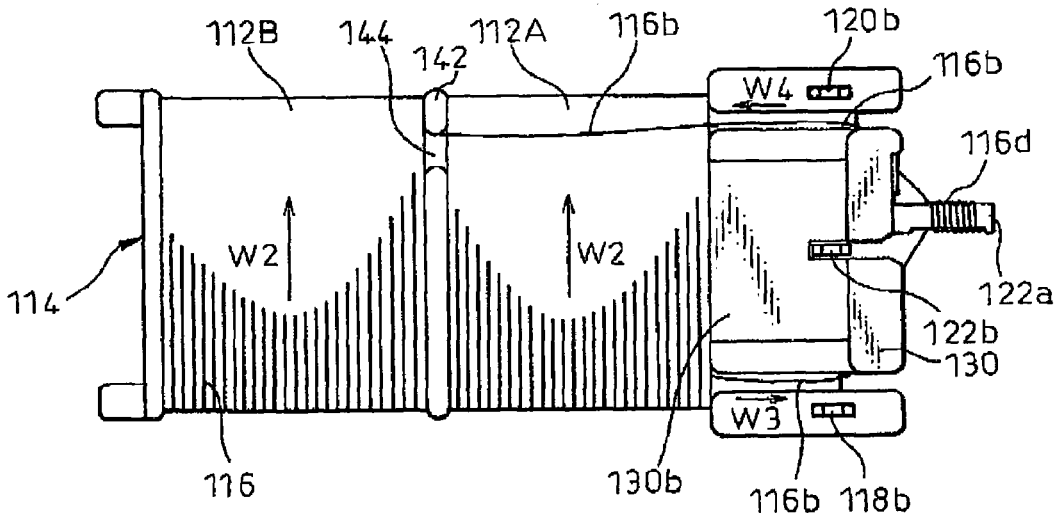
FIG. 19B is a bottom view of the coil assembly of FIG. 18.

FIGS. 18, 19A and 19B show a coil assembly 140, according to another embodiment of the present invention, configured so that the entire coil 112 is formed by a single continuous wire 116 and the winding efficiency can be equalized between the coil parts for the excitation circuits 134*a*, 134*b*. The coil assembly 140 according to the illustrated embodiment has a configuration substantially identical to that of the coil assembly 110 described above, except for the configuration of the bobbin 114 supporting the coil 112, and therefore corresponding components are denoted by like reference numerals and descriptions thereof are not repeated.

The bobbin 114 of the coil assembly 140 is further provided with a flat annular center collar 142 extending radially outward at the axial center of the body 124. The center collar 142 is disposed in parallel with the first and second collars 126, 128, and thereby a first region 114A supporting the wire 116 constituting one excitation circuit 134*a* (FIG. 11A) and a second region 114B supporting the wire 116 constituting the other excitation circuit 134*b* (FIG. 11A) are defined to be adjacent to each other in a direction along the center axis 112*a* of the coil 112.

In the coil assembly 140 configured as described above, a coil part 112A for one excitation circuit 134*a* and a coil part 112B for the other excitation circuit 134*b* can be formed respectively in the first region 114A and the second region 114B that are axially divided by the center collar 142 on the body 124 of the bobbin 114, so that the coil parts 112A, 112B can have mutually identical inner and outer diameters. Therefore, in the coil assembly 140, even when the entire coil 112 is formed by the single continuous wire 116, the winding efficiency for the coil parts 112A, 112B can be easily equalized. In this connection, in order to improve the accuracy and reliability of the automatic winding process of the wire 116 by a winding machine, the center collar 142 may be provided with a pair, of guide slits 144 that, can receive the first and second lead portions 116*a*, 116*b* of the wire 116 adjacent to the coil part 112B. It should be noted that, in FIGS. 18 to 19B, the laying procedure of the wire 116 in the automatic laying operation is shown by arrows W1 to W5 in the same manner as FIGS. 15 to 17B.

Figure 20A:
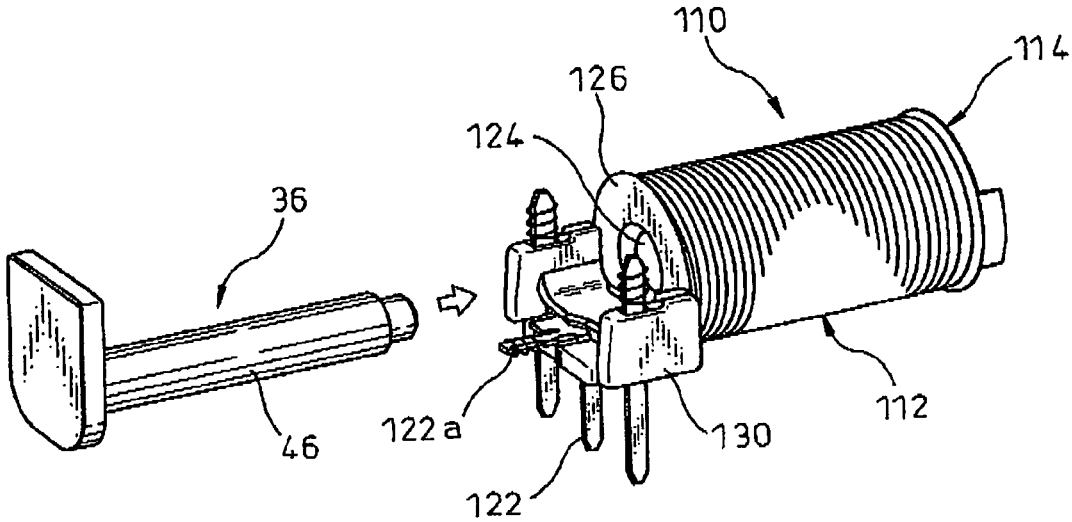
FIG. 20A is an illustration showing an assembling procedure of an electromagnet using the coil assembly of FIG. 11, which shows a state before an iron core is attached.
Figure 20B:
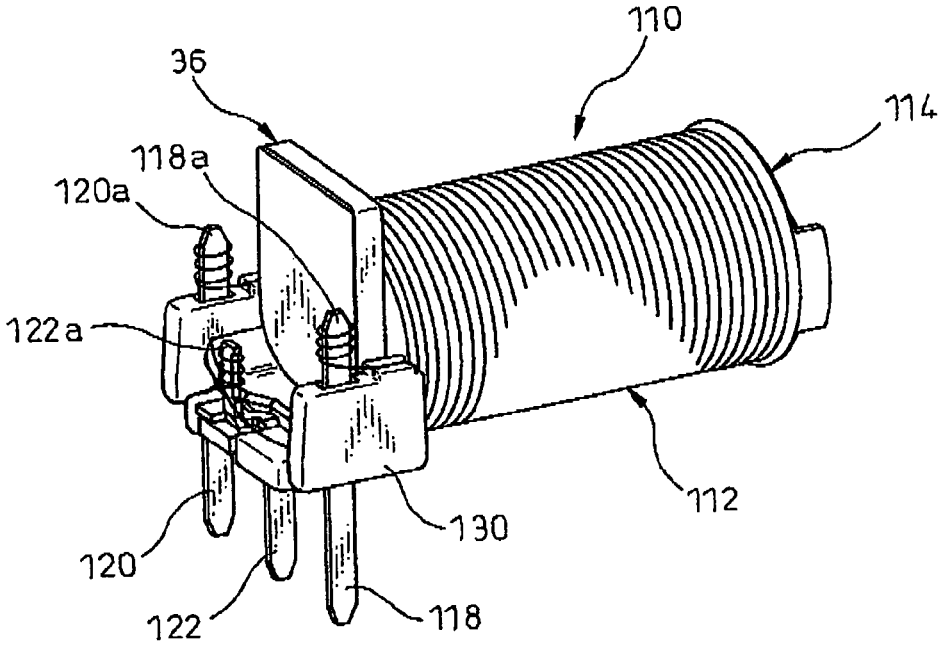
FIG. 20B is an illustration showing the assembling procedure of the electromagnet of FIG. 20A, which shows a state after the iron core is attached.

In the coil assembly 110, 110', 140 configured as described above, the tying portion 122*a* of the third coil terminal 122 disposed at the center of three coil terminals 118, 120, 122 is formed in advance to protrude in a direction generally parallel with the coil center axis 112*a* from the extension 130 of the bobbin 114, and therefore in the case where, for example, the electromagnet 26, 96, 100 shown in FIGS. 1 to 10 is assembled by using the coil assembly 110, 110', 140, the shaft portion 46 of the iron core 36 can be easily inserted into the body 124 from the side of the first collar 126 of the bobbin 114, as shown in relation to the coil assembly 110 in FIG. 20A. Thereafter, the tying portion 122*a* of the third coil terminal 122 may be bent on the extension 130 of the bobbin 114 toward a position generally parallel with the tying portions 118*a*, 120*a* of the first and second coil terminals 118, 120, so as to provide the coil assembly 110, 110', 140 with a form able to be accommodated in the casing 82 (FIG. 1, FIG. 20B).

The coil assembly according to the present invention is not limited to the configuration having three coil terminals, and may be applied to a configuration having two terminal pairs independent from each other (i.e., four coil terminals in total) for respective two excitation circuits. Further, the coil assembly according to the present invention is not limitedly applied to the polarized electromagnetic relay 10 in which the characteristic armature 28 shown in FIGS. 1 to 10 is incorporated in the electromagnet assembly 14, and can be used in polarized electromagnetic relays including other typical electromagnet assemblies. The present invention including the above configurations can be expressed as follows.

Thus, the present invention is a coil assembly for a polarized electromagnetic relay, including a coil with a center axis; a bobbin on which the coil is wound; and at least three coil terminals securely supported on the bobbin, a conductive wire (wires) forming the coil being connected to each of the coil terminals, wherein the coil constitutes two excitation circuits, each of which includes a terminal pair defined by any two of at least three coil terminals, characterized in that the wire is provided with a first lead portion extending between the coil and one coil terminal of the terminal pair and laid along one surface of the bobbin at a side close to the center axis of the coil, and a second lead portion extending between the coil and the other coil terminal of each terminal pair and laid along the other surface of the bobbin at a side away from the center axis.

Further, the present invention is a polarized electromagnetic relay including a base; an electromagnet assembly fitted to the base; a contact section fitted to the base and insulated from the electromagnet assembly; and a force transfer member disposed between the electromagnet assembly and the contact section and shiftable under an action of the electromagnet assembly to make the contact section open or close, wherein the electromagnet assembly includes an electromagnet, an armature driven by the electromagnet, and a permanent magnet carried on the armature, characterized in that the electromagnet includes a coil with a center axis; a bobbin on which the coil is wound; and at least three coil terminals securely supported on the bobbin, a conductive wire (wires) forming the coil being connected to each of the coil terminals; wherein the coil constitutes two excitation circuits, each of which includes a terminal pair defined by any two of at least three coil terminals; and wherein the wire is provided with a first lead portion extending between the coil and one coil terminal of the terminal pair and laid along one surface of the bobbin at a side close to the center axis of the coil, and a second lead portion extending between the coil and the other coil terminal of each terminal pair and laid along the other surface of the bobbin at a side away from the center axis.

While the invention has been described with reference to specific preferred embodiments, it will be understood by those skilled in the art that various changes and modifications may be made thereto without departing from the scope of the following claims.

The invention claimed is:

1. A polarized electromagnetic relay comprising:

a base;

an electromagnet assembly fitted to said base, said electromagnet assembly comprising an electromagnet, an armature driven by said electromagnet, and a permanent magnet carried on said armature;

a contact section fitted to said base and insulated from said electromagnet assembly; and a force transfer member disposed between said electromagnet assembly and said contact section, said force transfer member being shiftable under an action of said electromagnet assembly to make said contact section open or close;

wherein said electromagnet includes a coil with a center axis, an iron core provided with a shaft portion disposed along said center axis of said coil and a head portion extending outside of said coil and radially outward from one axial end of said shaft portion, and a yoke joined to another axial end of said shaft portion of said iron core and extending outside of said coil, said yoke including a major portion extending generally parallel with said center axis, an outer peripheral region of said head portion of said iron core being opposed to and spaced from a distal end region of said major portion of said yoke;

wherein said armature includes first and second electrically conductive plate elements holding said permanent magnet therebetween in a direction of magnetization of said permanent magnet and disposed to orient said direction of magnetization in parallel with said center axis of said coil, said armature being arranged linearly movably in a direction parallel with said center axis in a state where a part of said first electrically conductive plate element is inserted into a space defined between said outer peripheral region of said head portion of said iron core and said distal end region of said major portion of said yoke; and wherein said force transfer member is arranged to linearly shift in a direction parallel with said center axis to make said contact section open or close, while accompanying with a linear movement of said armature driven by said electromagnet in the direction parallel with said center axis.

2. A polarized electromagnetic relay as set forth in claim 1, wherein said coil is provided with a first outer circumferential region located closer to said major portion of said yoke and a second outer circumferential region located closer to said base; and wherein said force transfer member is disposed shiftably along said major portion of said yoke at a location close to said first outer circumferential region of said coil.

3. A polarized electromagnetic relay as set forth in claim 2, further comprising a casing secured to said base and accommodating said electromagnet assembly, said contact section and said force transfer member; wherein said base is provided with a bottom wall including a bulge portion exposed from said casing and bulging outward; and wherein said second outer circumferential region of said coil is received in a recess formed at a side opposite to said bulge portion of said bottom wall.

4. A polarized electromagnetic relay as set forth in claim 3, wherein said electromagnet further includes a bobbin provided with a body on which said coil is wound and an extension formed at one axial end of said body and extending outward from said coil, and a coil terminal securely supported on said extension of said bobbin, a wire end of said coil being connected to said coil terminal; and wherein said extension of said bobbin cooperates with said bottom wall of said base to provide an adhesive application surface used for bonding said casing to said base.

5. A polarized electromagnetic relay as set forth in claim 4, wherein said coil includes two conductive wires; and wherein said electromagnet includes three coil terminals, each being said coil terminal, to which wire ends of said two wires are connected, said three coil terminals being aligned in a direction orthogonal to said center axis and supported on said extension of said bobbin.

6. A polarized electromagnetic relay as set forth in claim 1, wherein said distal end region of said major portion of said yoke is provided with an annular portion surrounding said armature and said permanent magnet through a gap; and wherein respective parts of said first and second electrically conductive plate elements are inserted into spaces defined at opposite sides of said head portion of said iron core between said outer peripheral region of said head portion and said annular portion of said distal end region.

7. A polarized electromagnetic relay as set forth in claim 1, wherein said major portion of said yoke is disposed close to said force transfer member at one lateral side of said coil; wherein said yoke further includes a secondary portion disposed oppositely to said major portion and close to said base at another lateral side of said coil, said secondary portion extending generally parallel with said center axis; wherein a distal end region of said secondary portion extends at a location axially outside of said head portion of said iron core to be spaced from and opposed to said head portion; and wherein a part of said second electrically conductive plate element of said armature is inserted into a space defined between said outer peripheral region of said head portion of said iron core and said distal end region of said secondary portion of said yoke.

8. A polarized electromagnetic relay as set forth in claim 1, wherein said distal end region of said major portion of said yoke is provided with a sheared surface resulting from forming said yoke by a stamping process; and wherein a part of at least one of said first and second electrically conductive plate elements of said armature is disposed to face to, and be able to abut against, said sheared surface of said distal end region.

9. A polarized electromagnetic relay as set forth in claim 1, wherein said armature is fixedly joined to said force transfer member in a state where said permanent magnet is held between said first and second electrically conductive plate elements.

10. A polarized electromagnetic relay as set forth in claim 9, wherein said force transfer member has a rectangular profile, a major axis of said rectangular profile being disposed parallel with said center axis; and wherein a force application point engaged with said contact section is provided at one longitudinal end of said force transfer member and said armature is secured to a region of another longitudinal end of said force transfer member.

11. A polarized electromagnetic relay as set forth in claim 1, wherein said base is provided with a cylindrical wall accommodating at least a part of said electromagnet, said cylindrical wall being interposed between said electromagnet and said contact section.

12. A polarized electromagnetic relay as set forth in claim 1, wherein said electromagnet further includes a bobbin on which said coil is wound and at least three coil terminals securely supported on said bobbin, a conductive wire forming said coil being connected to each of said coil terminals; wherein said coil constitutes two excitation circuits, each excitation circuit including a terminal pair defined by any two of said at least three coil terminals; wherein each of said at least three coil terminals is provided with a tying portion to which said wire is connected and a termination portion defined away from said tying portion, said tying portion and said termination portion being disposed to protrude outside of said bobbin; wherein said bobbin is provided with a first surface defining a side from which said tying portion of one coil terminal of said terminal pair in each of said two excitation circuits protrudes and a second surface defining another side opposite to said first surface and from which said termination portion of said one coil terminal protrudes; and wherein said conductive wire is provided with a first lead portion extending between said coil and said tying portion of said one coil terminal of said terminal pair, said first lead portion being laid along said first surface of said bobbin, and a second lead portion extending between said coil and said tying portion of another coil terminal of said terminal pair, said second lead portion being laid along said second surface of said bobbin.

13. A polarized electromagnetic relay as set forth in claim 12, wherein said electromagnet includes three coil terminals securely supported on said bobbin, said three coil terminals including first and second coil terminals to which opposite wire ends of a single conductive wire forming said coil are respectively connected and a third coil terminal to which an intermediate point of said wire is connected; and wherein each of said first and second coil terminals defines said one coil terminal of said terminal pair in each of said two excitation circuits, and said third coil terminal defines said other coil terminal of said terminal pair.

14. A polarized electromagnetic relay comprising:

a base;

an electromagnet assembly fitted to said base, said electromagnet assembly comprising an electromagnet, an armature driven by said electromagnet, and a permanent magnet carried on said armature;

a contact section fitted to said base and insulated from said electromagnet assembly; and a force transfer member disposed between said electromagnet assembly and said contact section, said force transfer member being shiftable under an action of said electromagnet assembly to make said contact section open or close;

wherein said electromagnet includes a coil with a center axis, a bobbin on which said coil is wound, and at least three coil terminals securely supported on said bobbin, a conductive wire forming said coil being connected to each of said coil terminals;

wherein said coil constitutes two excitation circuits, each excitation circuit including a terminal pair defined by any two of said at least three coil terminals;

wherein each of said at least three coil terminals is provided with a tying portion to which said wire is connected and a termination portion defined away from said tying portion, said tying portion and said termination portion being disposed to protrude outside of said bobbin;

wherein said bobbin is provided with a first surface defining a side from which said tying portion, of one coil terminal of said terminal pair in each of said two excitation circuits protrudes, and a second surface defining another side opposite to said first surface and from which said termination portion of said one coil terminal protrudes; and wherein said conductive wire is provided with a first lead portion extending between said coil and said tying portion of said one coil terminal of said terminal pair, said first lead portion being laid along said first surface of said bobbin, and a second lead portion extending between said coil and said tying portion of another coil terminal of said terminal pair, said second lead portion being laid along said second surface of said bobbin.

15. A coil assembly used in a polarized electromagnetic relay, said coil assembly comprising:

a coil with a center axis;

a bobbin on which said coil is wound; and at least three coil terminals securely supported on said bobbin, a conductive wire forming said coil being connected to each of said coil terminals;

wherein said coil constitutes two excitation circuits, each excitation circuit including a terminal pair defined by any two of said at least three coil terminals;

wherein each of said at least three coil terminals is provided with a tying portion to which said wire is connected and a termination portion defined away from said tying portion, said tying portion and said termination portion being disposed to protrude outside of said bobbin;

wherein said bobbin is provided with a first surface defining a side from which said tying portion of one coil terminal of said terminal pair in each of said two excitation circuits protrudes, and a second surface defining another side opposite to said first surface and from which said termination portion of said one coil terminal protrudes; and wherein said conductive wire is provided with a first lead portion extending between said coil and said tying portion of said one coil terminal of said terminal pair, said first lead portion being laid along said first surface of said bobbin, and a second lead portion extending between said coil and said tying portion of another coil terminal of said terminal pair, said second lead portion being laid along said second surface of said bobbin.

16. A coil assembly as set forth in claim 15, comprising three coil terminals securely supported on said bobbin; wherein said three coil terminals include first and second coil terminals to which opposite wire ends of a single conductive wire forming said coil are respectively connected and a third coil terminal to which an intermediate point of said wire is connected; and wherein each of said first and second coil terminals defines said one coil terminal of said terminal pair in each of said two excitation circuits, and said third coil terminal defines said other coil terminal of said terminal pair.

17. A coil assembly as set forth in claim 15, wherein said bobbin is provided with a first region supporting said wire constituting one of said excitation circuits and a second region supporting said wire constituting other one of said excitation circuits, said first region and said second region being defined to be adjacent to each other in a direction along said center axis of said coil.

* * * * *

UNITED STATES PATENT AND TRADEMARK OFFICE

CERTIFICATE OF CORRECTION

PATENT NO. : 7,679,476 B2
APPLICATION NO. : 12/068037
DATED : March 16, 2010
INVENTOR(S) : Kazuo Kubono It is certified that error appears in the above-identified patent and that said Letters Patent is hereby corrected as shown below:

Title page, item [73] Column 1 (Assignee), Line 1, change "Componenet" to --Component--.

Column 21, Line 57, change "portion," to --portion--.

Signed and Sealed this

First Day of June, 2010

David J. Kappos

David J. Kappos
*Director of the United States Patent and Trademark Office*